United States Patent [19]

Munshower

[11] 3,956,811

[45] May 18, 1976

[54] APPARATUS FOR TERMINATING FLAT CONDUCTOR CABLE

[75] Inventor: Kenneth Munshower, Norristown, Pa.

[73] Assignee: Elco Corporation, Willow Grove, Pa.

[22] Filed: Oct. 21, 1974

[21] Appl. No.: 516,500

Related U.S. Application Data

[63] Continuation-in-part of Ser. No. 465,593, April 30, 1974.

[52] U.S. Cl. ..... 29/203 D; 29/203 DT; 29/628; 29/630 A; 227/141

[51] Int. Cl.[2] ..... H01R 43/04

[58] Field of Search ..... 29/203 R, 203 D, 203 DT, 29/203 DS, 203 P, 203 S, 203 B, 628, 629, 630 R, 630 A, 203 MW, 203 J, 203 HC; 339/17 F; 227/141; 269/56, 63, 65, 74

[56] References Cited

UNITED STATES PATENTS

| | | | |
|---|---|---|---|
| 3,553,836 | 1/1971 | Cootes | 29/203 DS |
| 3,713,072 | 1/1973 | Henschen et al. | 339/95 R |
| 3,810,289 | 5/1974 | Hannabery | 29/203 D |
| 3,819,104 | 6/1974 | Lang | 29/203 MW |
| 3,840,840 | 10/1974 | Worth | 339/17 F |

*Primary Examiner*—C. W. Lanham
*Assistant Examiner*—James R. Duzan
*Attorney, Agent, or Firm*—Burns, Doane, Swecker & Mathis

[57] ABSTRACT

Apparatus for use in terminating flexible flat conductor cable or the like with contacts having a termination section for terminating a conductor portion thereof includes a flexible, generally U-shaped carrier strip for carrying a plurality of longitudinally spaced ones of the contacts, an anvil assembly, a ram assembly, a stripping assembly, and a guide and positioning assembly. The guide and positioning assembly comprises a support surface and adjustable positioning stops for predetermining the lateral location of the flexible flat conductor, as well as a clamp for clamping the flexible flat conductor on the support surface with its conductor elements extending over termination pockets of the anvil assembly. These pockets are defined by anvil die inserts in slots of an anvil die block and generally U-shaped, longitudinally spaced projections on pressure pads. The die block cooperates with the carrier strip to locate in contacts in the termination pockets, and a stripper bar of the stripping assembly is movable to cammingly peel the carrier strip from the positioned contacts. The ram assembly includes a slotted ram die with ram die inserts positioned therein to present die faces toward the termination pockets. During termination, the ram enforces termination of conductor elements of the flexible flat conductor while progressively lowering the projections to progressively expose prongs of the contact. Bending of the prongs out of their common plane is inhibited by the legs of the projections and lateral support for the contacts during lancing is provided by those legs. The bias on the pressure pad enforces dislodging of contact portions lodged in the pockets during termination.

44 Claims, 21 Drawing Figures

APPARATUS FOR TERMINATING FLAT CONDUCTOR CABLE

RELATED APPLICATION

This application is related to commonly assigned application Ser. No. 465,594 filed on April 30, 1974 for "Method and Apparatus for Flat Conductor Cable Termination" by Charles E. Baker and Abraham Silverzweig, and this application is a continuation-in-part of application Ser. No. 465,593 filed on April 30, 1974 for "Flat Cable Termination Method and Apparatus" by Kenneth Munshower.

BACKGROUND OF THE INVENTION

The present invention relates to the termination of flexible flat conductor cable and the like. More particularly, this invention relates to termination of such cable and the like utilizing multiple contact connectors which may be of the type set forth in the above-mentioned applications.

As in the cases of the inventions of these applications, termination of flexible flat conductor cable according to the present invention entails piercing of the insulation with substantially no prior preparation of the cable being necessary at the location chosen to terminate the cable.

In the aforementioned Baker and Silverzweig application, there is disclosed a termination technique according to which flexible flat cable is terminated employing a contact having spaced, bendable prongs and abutment surfaces cooperable therewith. A die movable relative to said contact includes arcuate bending surfaces also cooperable with the prongs. These arcuate surfaces are positioned adjacent one another to define a die nose receivable between the prongs. The arcuate surfaces are operable, upon relative movement of the die toward the contact prongs with a conductor cable between the prongs and the arcuate surfaces, to controllably enforce penetration of the prongs through the insulation and a conductor portion of the flat conductor cable and bending of the prongs into engagement with the conductor of that cable crimped between the prongs and the cooperable abutment surfaces of the contact. The die nose, upon such relative movement, is operable to force the conductor portion of the flat conductor cable between the prongs and into crimped engagement with the prongs.

In the aforementioned Munshower application, there is disclosed a termination technique according to which flat cable is terminated employing a similar contact. The die nose that is receivable between the spaced prongs has an extent greater than distance therebetween. Upon relative die movement the die nose is operable to form projections on the prongs crimping a portion of the conductor between the prongs.

The present invention is especially adapted to carry out the above-discussed termination techniques, particularly in connection with efficient, simultaneous termination with a plurality of contacts.

OBJECTS AND SUMMARY OF PREFERRED FORMS OF THE INVENTION

It is a general object of the present invention to provide a novel method and apparatus for efficient, simultaneous termination of flexible flat conductor cable or the like with a plurality of contacts.

It is a particular object of the present invention to provide a novel apparatus for such termination wherein control over bendable portions of the contacts during termination is enhanced.

It is a further object of the present invention to provide such a novel apparatus wherein positioning of the cable or the like for termination is facilitated.

It is another object of the present invention to provide such a novel apparatus for use with a flexible contact carrying strip wherein the strip may be efficiently peeled from contacts positioned for termination.

It is still another object of the present invention to provide such a novel apparatus wherein easy release of the cable or the like after termination is obtained.

According to a preferred method embodiment of the present invention intended to accomplish the foregoing and other objects, conductor elements of flexible flat conductor means are simultaneously terminated with contacts having spaced, bendable, generally coplanar penetrating prongs for engaging a conductor portion of the flat conductor means and being crimped to the flat conductor means. The flexible flat conductor is supported on a biased, discontinuous support surface with the conductor elements above longitudinally spaced, termination die pockets. The contacts are positioned in the longitudinally spaced die pockets with the prongs projecting toward the conductor elements. Initially, the prongs are maintained below the discontinuous support surface. To effect termination, a ram, which includes die bending surfaces aligned with the die pockets, is moved into engagement with the flexible flat conductor. Movement of the ram urges the conductors toward the prongs and lowers the discontinuous support surface against the bias thereon. In this fashion, the ram enforces progressive penetration of the flexible flat conductor means by the prongs and enforces bending of the prongs into crimped condition. Bending of the prongs out of their common plane during the enforced bending to the crimped condition is inhibited and failure of the prongs by buckling is militated against.

According to a preferred apparatus embodiment of the invention intended to accomplish at least some of the foregoing and other objects, an anvil for use in terminating flexible flat conductor means with contacts having termination sections for terminating a conductor portion of the flexible flat conductor means is also provided. The anvil comprises elongate pressure pad means including a plurality of longitudinally spaced projections separated by slots, and presenting a discontinuous support surface engagable with the ribbon. Anvil die block means includes a recess zone for reception of the pressure pad assembly projections, and also includes a plurality of receiving slots extending transversely of the recess zone and aligned with the slots of the pressure pad means. Spring means is operable to yieldably bias the pressure pad means to an extended position.

Received in both the receiving slots of the anvil die block means and the slots of the pressure pad means are anvil die inserts. These are fixed in the anvil die block means. The anvil die inserts present a support surface for the contact termination sections between adjacent ones of the projections of the pressure pad means.

Upon application of a termination force, the pressure pad means is operable to responsively move relative to the anvil die inserts to a retracted position against the bias of the spring means.

The projections of the pressure pad means define, together with the slots and the contact support surfaces of the insert means, narrow termination pockets. The spring means is operable to urge the discontinuous support surface defined by the projections against the supported flexible flat conductor with a force sufficient to enforce dislodging of the contacts from the termination pockets after termination is completed.

In the extended position of the pressure pad means, the projections project above penetrating portions of the contacts positioned on the support surfaces of the inserts located between adjacent ones of the projections. During termination the perssure pad means is operable to responsively move to the retracted position to progressively expose the penetrating prongs of the contacts.

Preferably, the contacts are initially carried by a flexible, elongate, generally U-shaped carrier strip supporting a plurality of the contacts in longitudinally spaced locations. The anvil die block means includes elongate locating means on opposite sides of the recess zone. This locating means is cooperable with the legs of the U-shaped carrier strip to orient the carrier strip with the contacts carried thereby received between adjacent ones of the projections.

It is preferred that the projections of the pressure pad means are generally U-shaped. In this connection, stripping means movable generally centrally of the generally U-shaped projections is operable to strip the carrier from the contacts received between the projections. The stripping means may be comprised of an elongate stripper bar generally T-shaped in cross section. A first leg of the stripper bar is receivable between the generally U-shaped projections, and a second leg disposed above the projections is operable to cammingly engage with the carrier strip to lift the strip from the contacts.

A ram movable relative to the anvil to effect termination includes ram die block means provided with a plurality of receiving slots extending transversely thereacross. These receiving slots are longitudinally aligned with the receiving slots of the anvil die block means. Ram die inserts are receivable in the ram die block receiving slots and include die surfaces aligned with the narrow termination pockets of the anvil. Wall means of the ram die block means define, together with the ram die block inserts, narrow contact control pockets aligned with the termination pockets.

The anvil may include adjustable stop means to provide for a lateral adjustment of the contacts received between the projections of the pressure pad assembly so as to insure correct positioning relative to the movable ram.

The locating means of the anvil cooperable with the carrier includes elongate ridge means on opposite sides of the recess zone as well as a groove defined along at least one of the ridge means for mating with one leg of the carrier strip. The receiving slots extend transversely across the ridge means and the ridge means defines an elongate, generally U-shaped die section longitudinally aligned with the projections of the pressure pad assembly. The ridge means are elevated above the contact support surfaces of the inserts.

Extensions of the ridge means establish guide means for guiding the advance and retraction of the stripper bar. Stripper spring means is provided for biasing the stripper bar to a retracted position remote from the pressure pad assembly projections. Adjacent the anvil means, guide and positioning means is located and is operable to orient the flexible flat conductor means relative to contacts positioned for termination. The guide and positioning means includes a support surface, and first and second adjustable positioning stop means for predetermining the lateral location of the flexible flat conductor. Clamp means is included for clampling the flexible flat conductor on the support surface.

The first and second adjustable positioning stop means include latching means cooperable with the clamp means for releasably maintaining the clamp means in clamping position. One of the adjustable positioning stop means includes mounting means for pivotally mounting clamp means for movement between said clamping position and inactive positions. The latching means of that one of the adjustable positioning stop means also is operable to releasably maintain the clamp means in a stable, inactive position.

Other objects and advantages of the present invention will become apparent with reference to the following detailed description of preferred embodiments thereof in connection with the accompanying drawings, wherein like reference numerals have been applied to like elements and in which:

THE DRAWINGS

Figure 17:
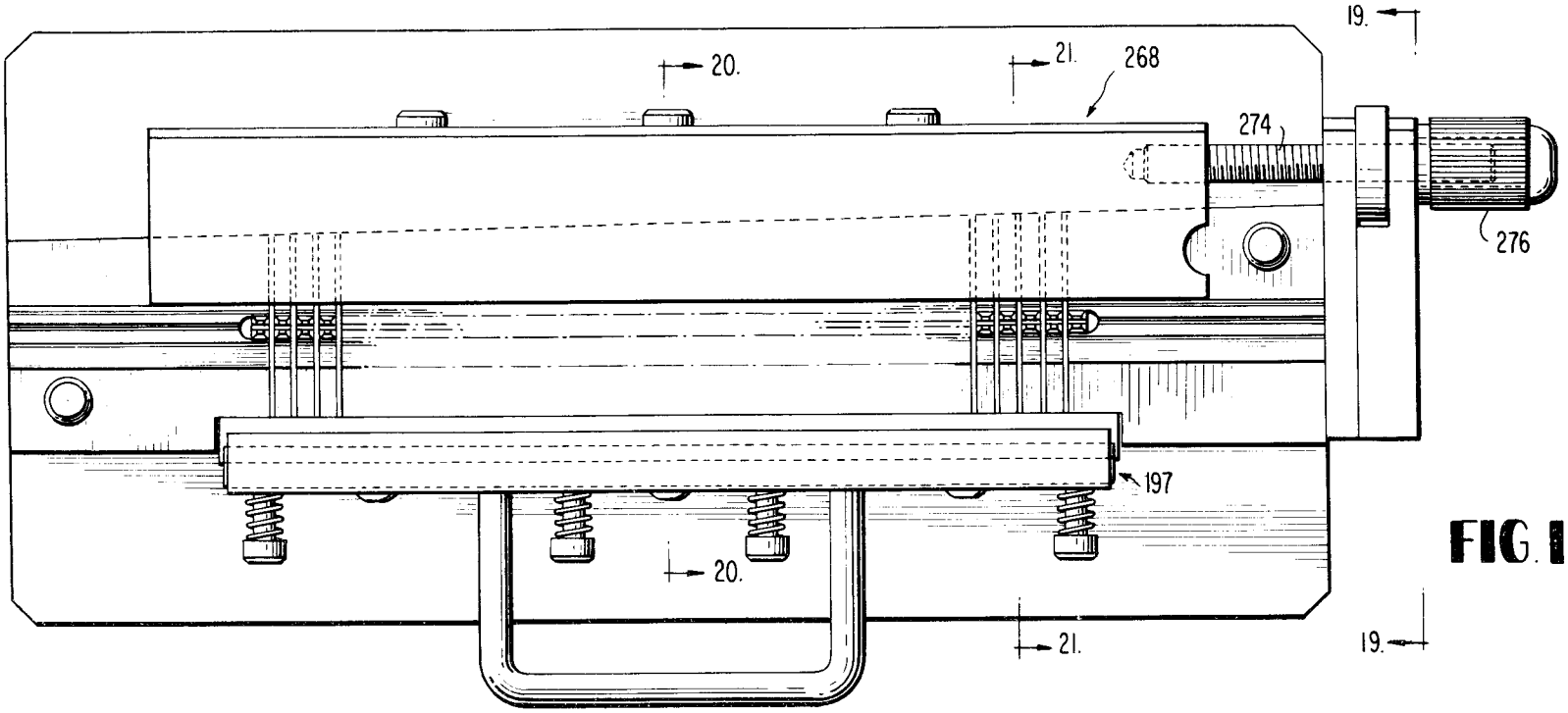
FIG. 17 is a plan view of an alternative anvil assembly according to the present invention.
Figure 18:
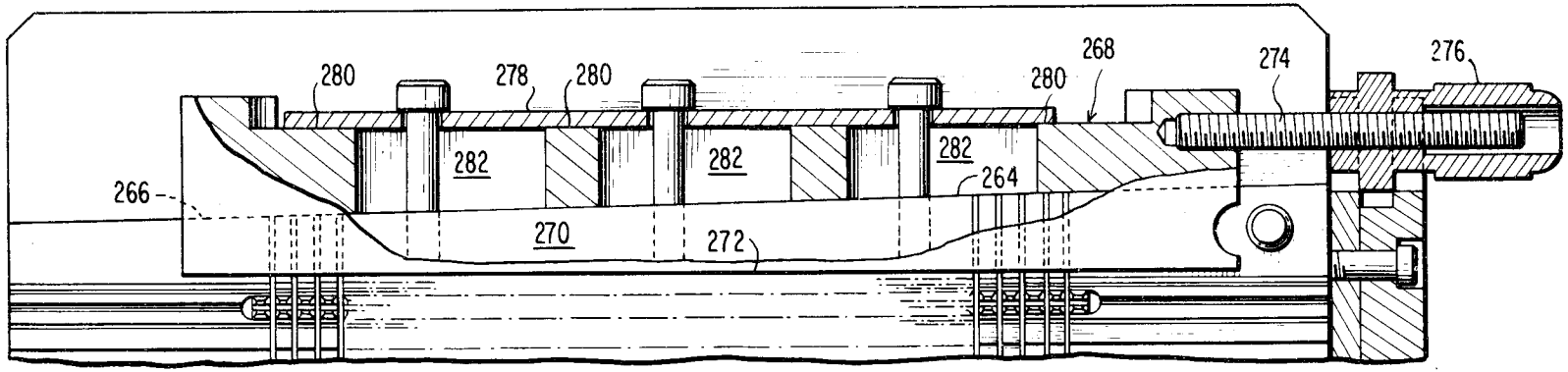
FIG. 18 is a partial plan view similar to that of FIG. 17, but partially broken away to illustrate the adjustment elements in section.
Figure 19:
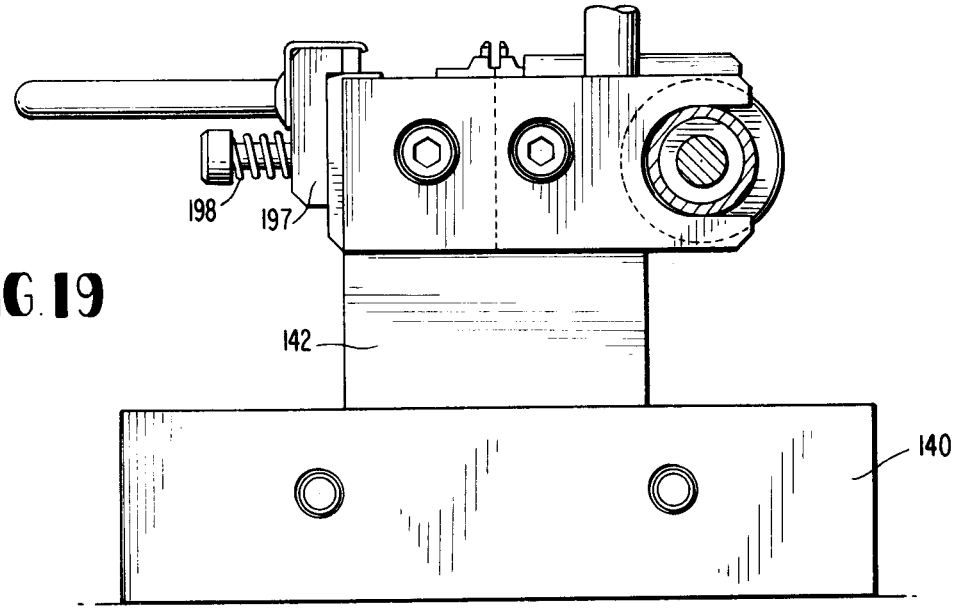
FIG. 19 is an end view of the anvil assembly of FIG. 17, taken along line 19—19 thereof.
Figure 20:
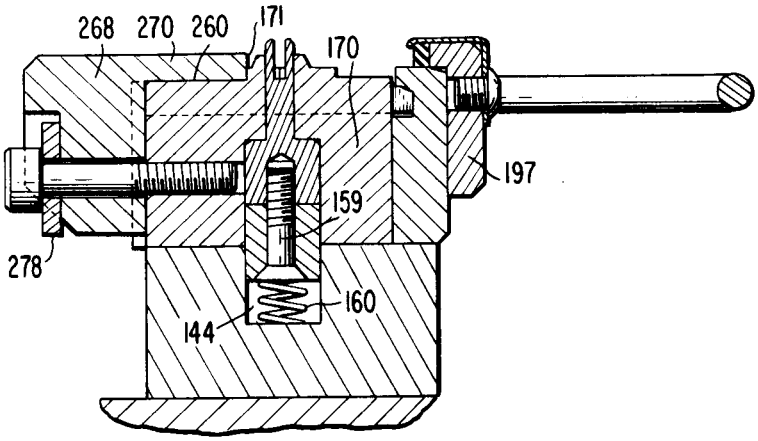
Figure 21:
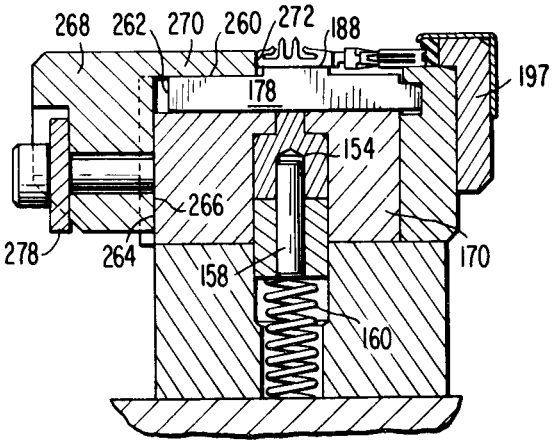

FIGS. 20 and 21 are cross-sectional elevational views, respectively, taken along lines 20—20 and 21—21 of FIG. 17.

DETAILED DESCRIPTION

General Summary

Figure 1:
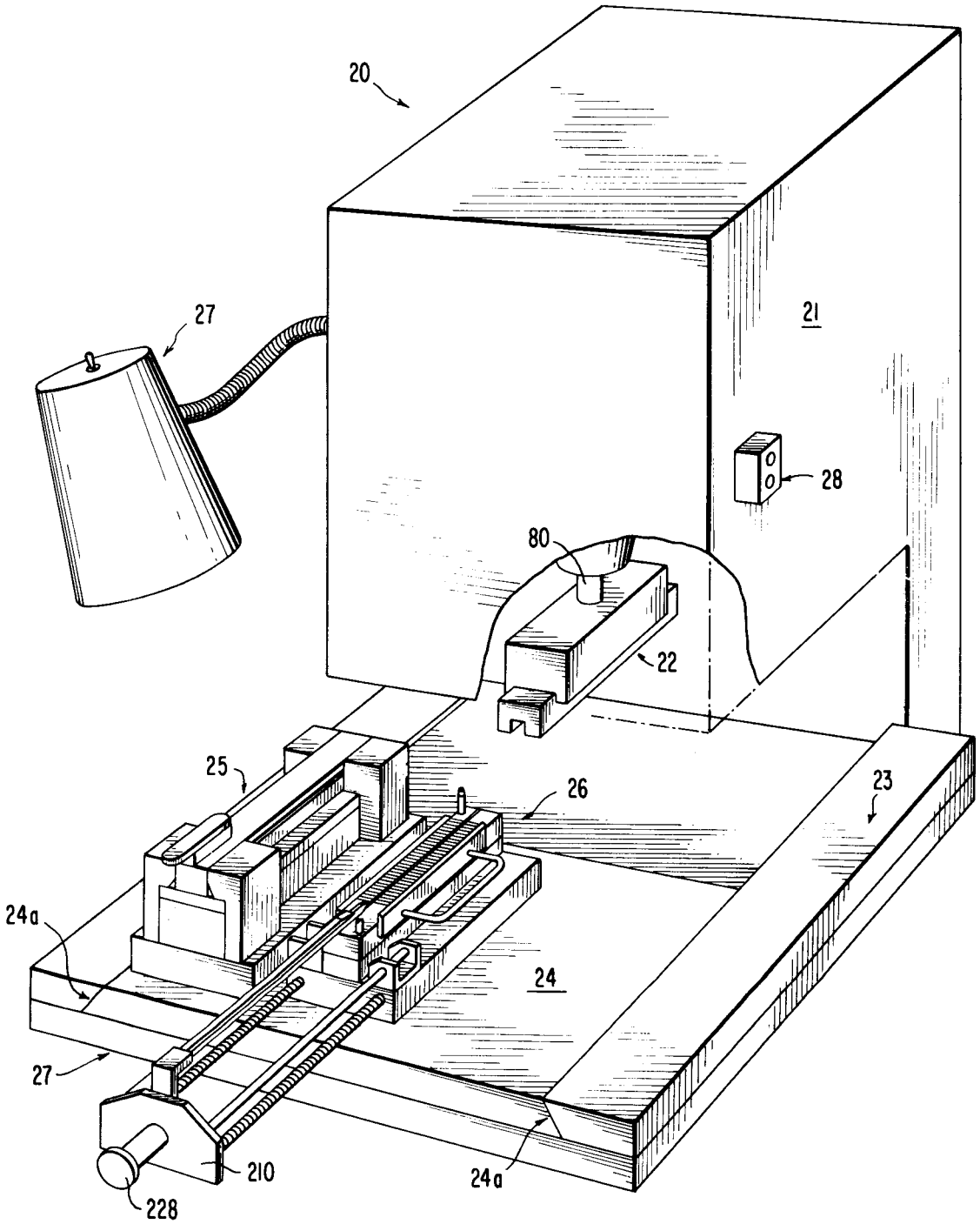
FIG. 1 is a schematic perspective view of an apparatus according to the present invention, wherein the general orientation of a ram assembly, an anvil assembly, a stripper assembly and a guide and positioning assembly may be seen.

With reference to FIG. 1, basic elements of an apparatus 20 for terminating flexible flat conductor means according to the present invention will be appreciated.

The apparatus 20 includes a housing 21 mounting a ram assembly 22. Beneath the housing 21 and integrally connected thereto is a support table assembly 23. Mounted on the support table assembly 23 is a slide plate 24 on which a guide and positioning assembly 25, an anvil assembly 26, and a stripper assembly 27 are supported. As illustrated at 24, the slide plate 24 may include angled sides that ride along complementarily configured side rails. A suitable locking arrangement (not shown) may be provided for maintaining the slide plate 24 in selected adjusted positions.

The guide and positioning assembly 25 is operable to orient the flexible flat conductor means in a termination position relative to contacts positioned on the anvil assembly 26. Thereafter, the slide plate 24 is advanced to locate the properly oriented flexible flat conductor means, and the contacts positioned on the anvil assembly 26, beneath the ram assembly.

A light 27 mounted on the housing 21 aids visibility to the operator in connection with orienting the flexible flat conductor means and other operations preparatory to termination.

Also mounted on the housing 21 is a switch 28 which, upon activation by the operator, initiates advance of the ram assembly 22 toward the anvil assembly 26 to effect termination.

Figure 4:
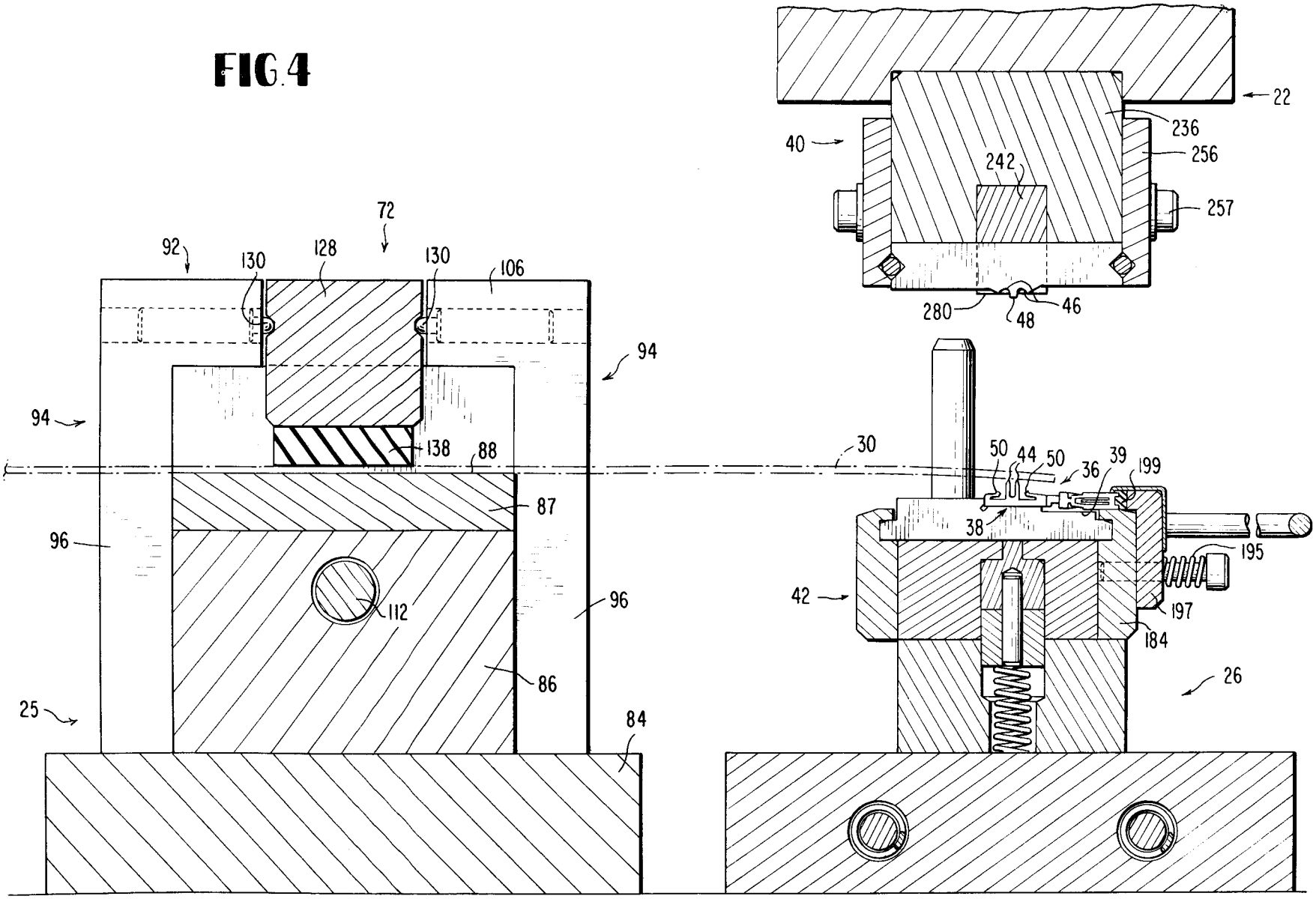
FIG. 4 is a cross-sectional view, with certain elements omitted for clarity, of the apparatus taken in the direction of line 4—4 of FIG. 3, with a box contact in position on an anvil die insert of the anvil assembly in preparation for termination beneath the ram assembly, and with a flat conductor cable shown, in phantom, in position for termination.

In FIG. 4, the flexible conductor means, schematically depicted in phantom at 30, is shown in position for termination. In other of the accompanying drawings, or example, FIG. 10, the flexible flat conductor means is illustrated in section in the form of a conventional flat conductor cable 30. It should, however, be noted that although the flexible flat cable means to be terminated is illustrated in the accompanying drawings as a conventional flat conductor cable 30, the term flexible flat conductor means is intended to embrace flat cable (with round or flat conductors), flexible etched circuitry, etc.

Figure 10:
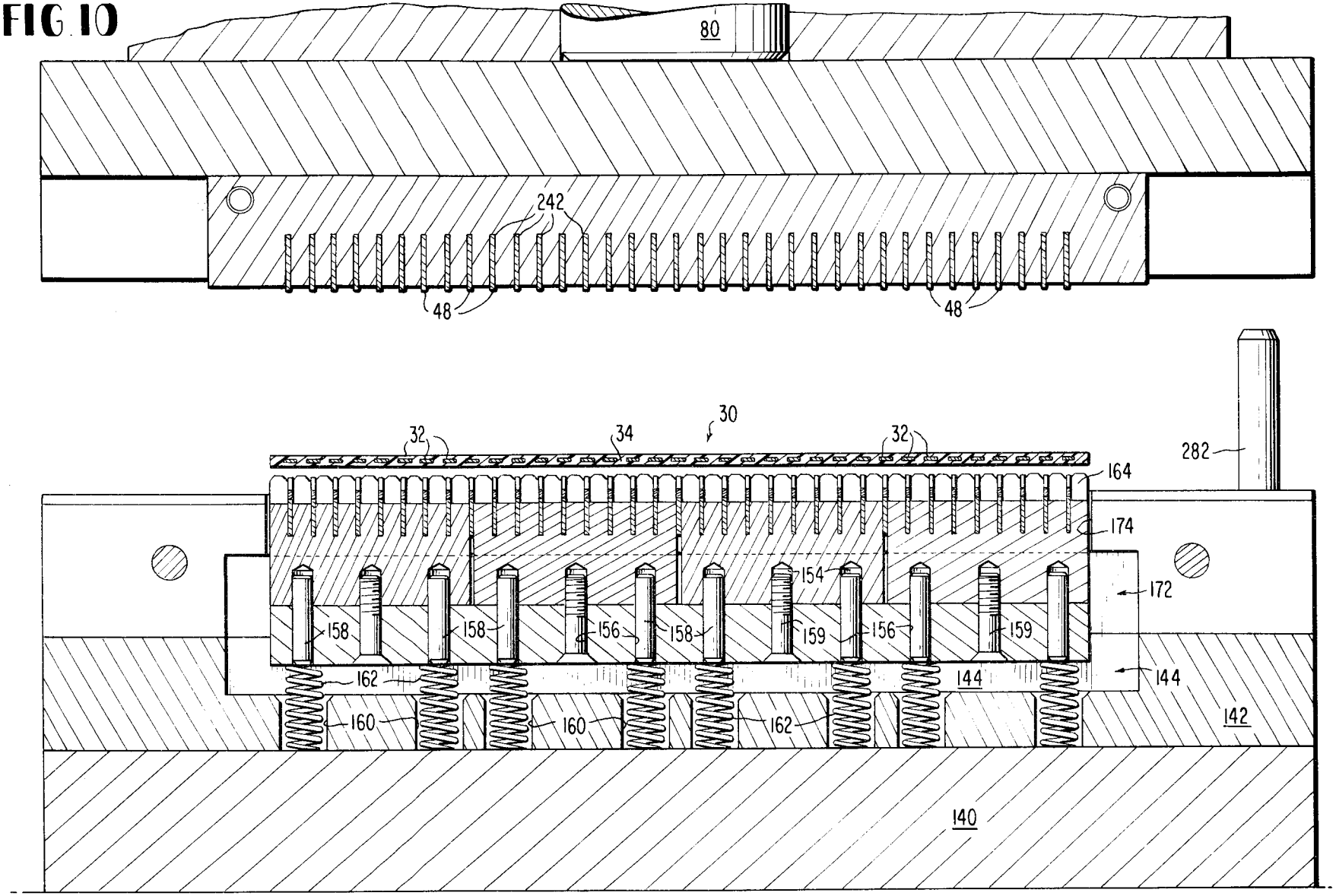
FIG. 10 is a longitudinal cross-sectional view, in the direction of line 10—10 of FIG. 3, through the ram assembly and anvil assembly, with a flat conductor cable shown in position for termination.

As may be seen in FIG. 10, the illustrated flexible flat conductor cable 30 is in the form of a ribbon comprised of a plurality of parallel and spaced-apart conductors 32, which themselves are generally ribbon-like. These ribbon-like conductors are embedded in an insulating film 34 of a polyester or similar material. Mylar (polyethylene terephthalate), Kapton (a polyimide), and Teflon (polytetrafluoroethylene) are typically used as an insulating material in flat conductor cables. It is envisioned that these and a variety of other similar materials would be suitable.

In FIG. 4, there may be seen one of a plurality of contacts 36, with which the cable 30 is to be terminated. The illustrated contacts 36 of FIG. 4 are box contacts of the type described in commonly assigned U.S. patent application Ser. No. 480,314 filed June 17, 1974 for "Terminating Apparatus for Flat Conductor Cables", the disclosure of which application is hereby incorporated by reference. Each contact 36 has a tail section 38 which functions as a termination section, and an integral matable contact 39.

Figure 12:
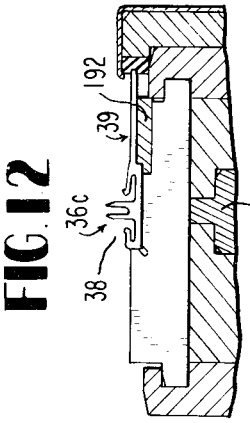
FIG. 12 is a cross-sectional view similar to the right-hand lower portion of FIG. 4 but showing a solder tab contact in position of the anvil assembly.
Figure 13:
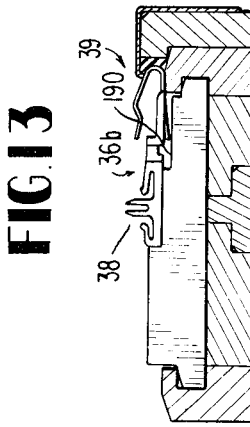
FIG. 13 is a cross-sectional view similar to the right-hand lower portion of FIG. 4, but showing a card edge type contact in position on the anvil assembly.

In FIGS. 12 and 13, a solder tab contact **36*a* and a card edge type contact 36*b* are respectively shown in position on the anvil assembly 26. These contacts also have tail sections 38** that function as termination sections.

The termination sections 38 are of the type disclosed in commonly assigned U.S. patent application Ser. Nos. 465,594 and 465,593 both filed on Apr. 30, 1974, respectively, for "Method and Apparatus for Flat Conductor Cable Termination" and "Flat Cable Termination Method and Apparatus", the disclosures of which are hereby incorporated by reference.

As may be seen in FIG. 4, during termination the cable 30, with the contact termination sections 38 located in an anvil die assembly 42 of the anvil assembly 26, is positioned below a ram operated die assembly 40 of the ram assembly 22. Cable penetrating prongs 44 of the contact termination sections 38 are located in general alignment with ram die bending surfaces 46.

These bending surfaces 46 are arcuate and are positioned adjacent one another to define a die nose 48 receivable between the prongs 44. The configuration of the arcuate bending surfaces 46 is such as to establish the final, crimped prong configuration at termination.

A lancing operation is accomplished by effecting relative movement between the ram die assembly 40 and the contact termination sections 38 in the anvil die assembly 42. The single lancing operation will enforce initial prong penetration through the conductors 32 (FIG. 11) of the cable and through the insulating layers, and prong bending away from one another in their common plane under control of the bending surfaces 46, as well as repenetration of the bent-around prongs through the upper insulation layer and penetration of abutment surfaces 50 of the contact termination sections 38 into the lower insulation layer. At the same time, the die nose 48 is operable to form a connector bridge between the prongs by forcing the conductor portion of the cable and the insulation between the prongs also into crimped engagement with the prongs.

In addition, the die, primarily through the agency of the die nose 48, may function as a swaging tool to form the prong projections adjacent the connector bridge formed between the prongs. In this connection the die nose may be provided with square corners, as depicted in FIG. 4, and with a lateral extent greater than the distance between the generally parallel faces of the spaced prongs so that the die nose 48 swages or shaves lower portions of the prongs to form the generally triangularly configured projections or nubs in the manner set forth in the aforementioned application Ser. No. 465,593. Those projections of the prongs envelop the connector bridge, making contact with the conductor of the cable.

Figure 6:
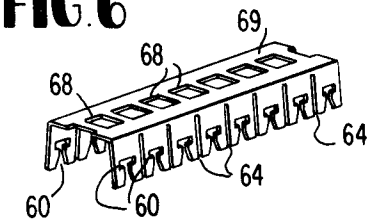
FIG. 6 is a perspective view showing a portion of a contact carrier strip cooperable with the anvil assembly.

Placement of the termination sections 38 of the contacts 36 in termination position on the anvil assembly 42 is facilitated by a carrier 37 (see FIG. 6). The carrier 37 initially supports a plurality of the contacts 36 in longitudinally spaced positions. Preferably the strip 37 is in the form of a flexible carrier strip of the type described in commonly assigned U.S. patent application Ser. No. 288,851 filed Sept. 13, 1972 for "Pin Terminal Carrier Strip", the disclosure of which is hereby incorporated by reference. This carrier strip 37 is constituted by an elongate, generally U-shaped channel member of yieldable material such as polyester. The side legs of the channel member are provided with longitudinally spaced, laterally aligned carrier slots 60. These slots 60 support the contact termination sections 38 (see FIG. 9) by yieldably receiving those sections at arms 62 which provide the aforementioned abutment surfaces 50 of the contact termination sections 38. Flexibility of the strip 37 is enhanced by longitudinally spaced relief slots 64 alternating with the carrier slots 60 so as to establish carrier tabs 66 containing the carrier slots 60. One laterally adjacent set of tabs 66 supports one contact.

If desired, means (not shown) may be automatically provided to feed the carrier 37 supporting the contacts into position on the anvil assembly from a coiled roll or the like and to sever desired lengths of that section, or to automatically feed precut sections of carrier strip into position on the anvil assembly.

The base 69 of the strip 37 is provided with a plurality of longitudinally spaced apertures 68 at the zones between each longitudinally spaced set of carrier tabs 66.

Figure 7:
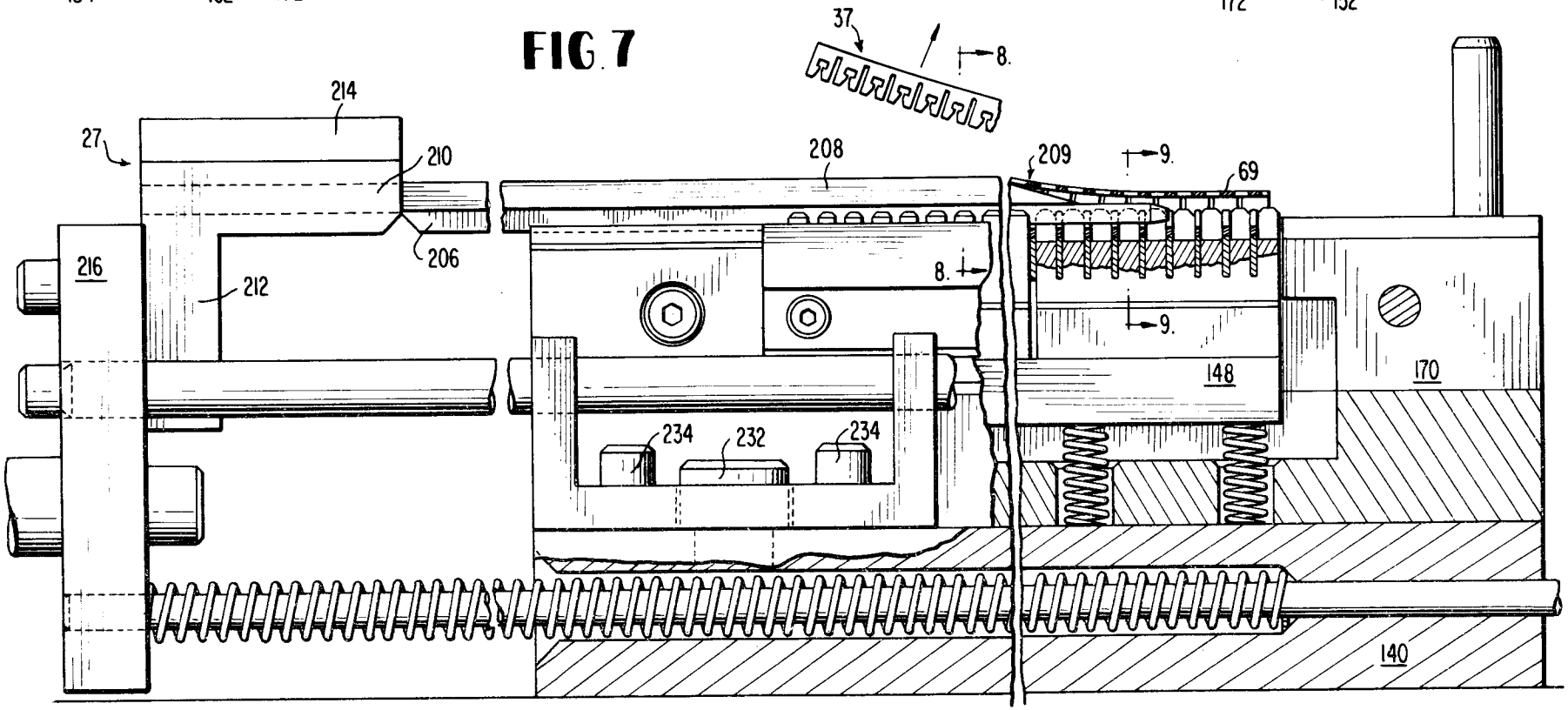
FIG. 7 is an elevational view, partially in section, depicting removal of the contact carrier strip from the anvil assembly by the stripper assembly.

As will be subsequently described, the anvil assembly 26 cooperates with the carrier strip 37 to locate the contact termination sections in position for termination. After placement of the carrier strip on the anvil assembly 26 employing this locating function, the strip 37 is removed from the contacts utilizing the stripper assembly 27 described in further detail below. (See FIG. 7.) When the contacts are located in termination position, the cable 30 is next positioned.

In this regard, the guide and positioning assembly 25 may be employed. This assembly aids in locating the generally parallel conductors 32 of the cable 30 directly above the penetrating prongs 44 of the longitudinally spaced contact termination sections 38 positioned in the anvil assembly 26. A clamp 72 of the guide and positioning assembly 25 holds the cable 30 in the desired position. (See FIG. 4.)

Thereafter, an operator releases the slidable mounting plate 24 on which the guide and positioning assembly 25 and the anvil assembly 26 are supported. After release, the plate 24 is advanced from the full line position of FIG. 3 to the phantom line position thereof, so as to locate the anvil assembly 26 beneath the ram assembly 22 mounted in the machine housing 21 above the zone of the plate 24 and members supported thereby.

Following positioning of the anvil assembly 26, the operator activates the ram activation switch 28. This switch 28 is operable in any suitable manner to cause extension of a ram arm 80 (FIG. 1) toward the anvil assembly 26 to effect simultaneous termination of the cable 30 by all the contacts 36 positioned in the anvil assembly 26. (See FIG. 11.)

As will be discussed more fully below, provision is made in the anvil assembly 26 to minimize, during termination, the possibility of canting of portions of the contacts 36 remote from the termination sections 38 so as to minimize problems in the subsequent assembly of the terminated cable 30. In addition, provision is made in the anvil assembly 26 to control the plane of bending of the penetration prongs 44 of the contacts during termination and to facilitate release of the terminated cable 30 from the anvil assembly 26.

Detailed Structure and Operation

The Guide and Positioning Assembly

Figure 3:
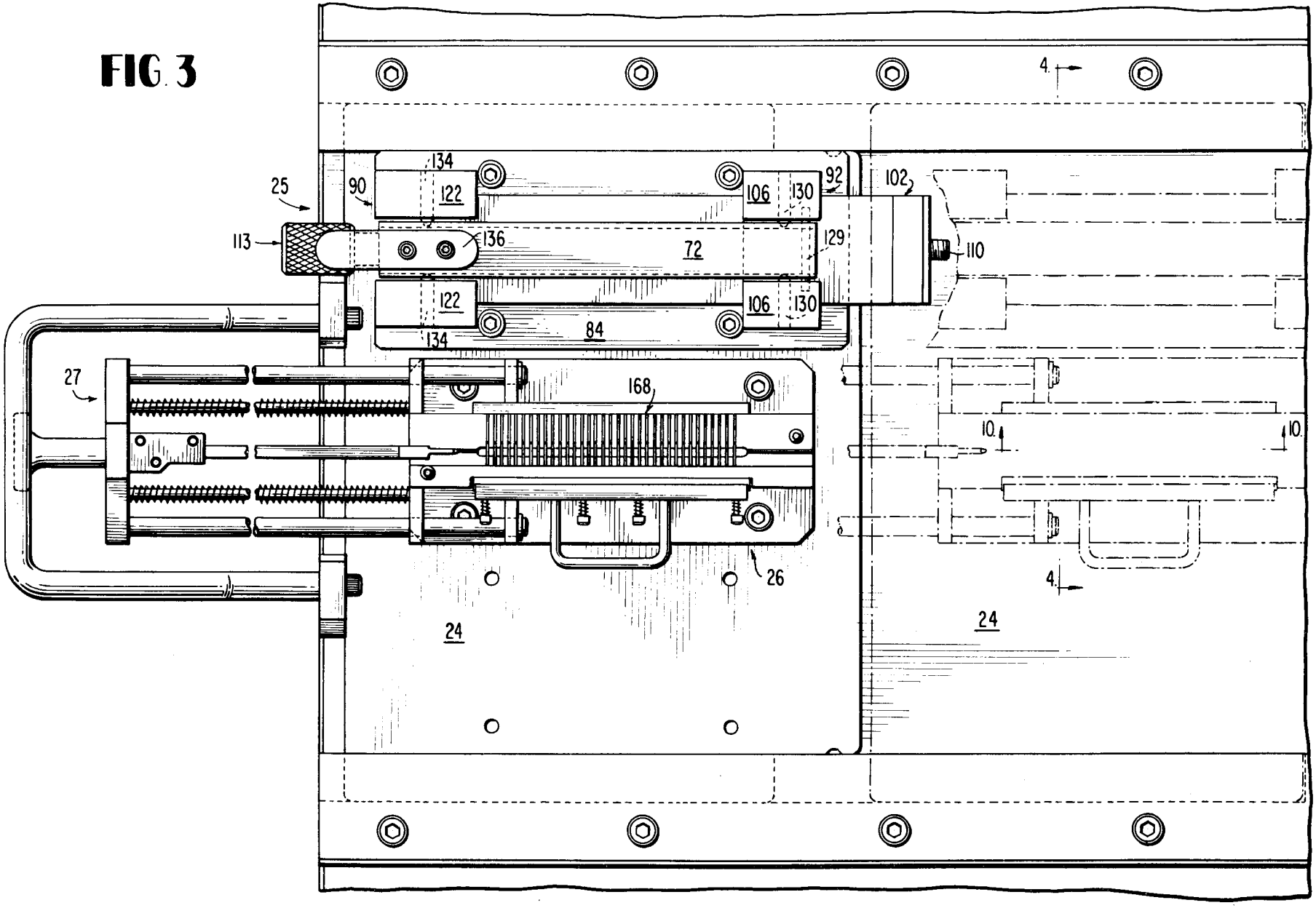
FIG. 3 is a plan view taken in the direction of line 3—3 of FIG. 2 but showing in full line the anvil assembly, the stripper assembly, and the guide and positioning assembly in the position where the side plate on which they are mounted is retracted, the extended position being depicted in phantom.
Figure 14:
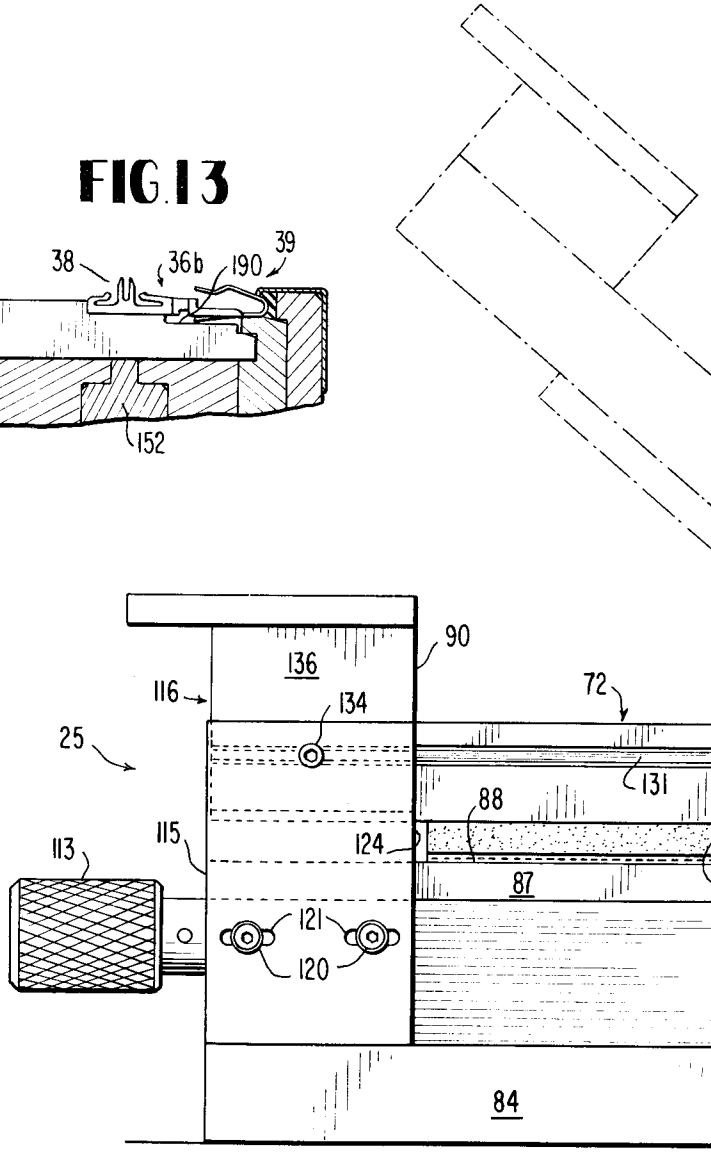
FIG. 14 is a side elevational view of the guide and positioning assembly.

With reference to FIGS. 3, 4 and 14, the details of the previously identified guide and positioning assembly 25 may be understood.

That assembly 25 includes a base plate 84 suitably fixed to the earlier mentioned slidable support member 24. Fixed to the base plate 84 in any suitable manner is a guide block 86 on which a slidable plate 87 is mounted. This slidable plate 87 presents an upper support surface 88. At the forward and rear ends of the guide block, first and second adjustable positioning stops 90 and 92 for predetermining the lateral location of the cable 30 are located.

The rear stop 92 includes left and right upstanding, generally L-shaped bracket units 94 having side legs 96 which contiguously straddle the sides of the guide block 86 and the sides of the slide plate 87. These side legs 96 of the brackets 94 are provided with holes for receiving locking screws 98 that extend into and are slidable along grooves 100 in the sides of the guide block.

Also straddled by the bracket side legs 96 is a generally L-shaped adjustment arm 102 having one member 103 that is elevated above the support surface 88. The bracket side legs 96 are fixed to the adjustment arm by suitable fasteners 105. Top legs 106 of the rear bracket unit 94 contiguously overlie the adjustment arm 102 in spaced, facing relationship.

A tail member 108 of the adjustment arm 102 projects downwardly behind the guide block 86. Threadably received by this tail member 108 is a micrometer adjustment screw 110. The screw 110 is an extension of a rod 112 that projects generally centrally through the guide block 86 and is controlled by a micrometer adjustment head 113 at the forward end thereof.

A spring 114 mounted on the rod 112 bears against the tail member 108 of the adjustment arm 102 and against the rear surface of the guide block 86 to bias the rod rearwardly, thus bringing the head end 113 of the micrometer adjustment into engagement with the forward surface of the guide block, as indicated at 115.

As will be apparent, turning of the adjustment head 113 moves the adjustment arm 102 and the attached stop bracket units 94 of the rear stop 92 closer to or farther from the forward stop 90.

The forward stop 90 also includes left and right upstanding, generally L-shaped bracket units 116. Side legs 118 of these brackets also contiguously straddle the sides of the guide block 86 and the sides of the slidable plate 87. The side legs 118 are suitably attached to the slidable plate 87. Locking screws 120 project through slots 121 in the side legs 118 of the forward bracket units 116. These locking screws 120 releasably cooperate with detent holes (not shown) in the side of the guide block to maintain the bracket units 116 in a desired adjusted position closer to or farther from the rear stop 92.

Upper legs 122 of the forward bracket units 116 project toward one another in spaced, facing relationship.

Surfaces 124 and 126 represented on the one hand by the front bracket units 116 and on the other hand by the rear bracket units 94 and the adjustment arm 102 constitute the adjustable stop surfaces that predetermine the lateral location of the cable 30.

In operation, the stop surfaces 124 and 126 are separated sufficiently to accommodate the width of the cable 30 to be terminated. The cable is then rested on the support surface 88 with a projecting portion thereof overlying the termination locations of anvil assembly 26. The rear stop surface 126 is then adjusted, utilizing the micrometer head 113 and the rear locking screws 98 so that when an edge of the cable is positioned against that stop surface 126, the conductors 32 of the cable are longitudinally aligned with termination locations on the anvil assembly 26.

Next, the front stop surface 124 is adjusted. This is accomplished by releasing the front locking screws 120 and moving the front bracket units 116 toward the rear bracket units 94. During this movement, the slide plate 87, to which the side legs 118 of the front bracket units are attached, slide on the guide block 86. The slide plate is receivable under the adjustment arm 103 of the rear stop 92 as indicated at 127 in FIG. 14. Movement of the front stop 90 is accomplished until the front stop 124 bears against the front edge of the cable 30. Thereafter, the cable is clamped to the support surface 88.

For this purpose, the clamp 72 is provided. This clamp is comprised of an elongate bar 128 pivotally mounted adjacent one end thereof by a pivot pin 129 projecting from the top legs 106 of the rear adjustment bracket units 94. The bar 128 has a width commensurate with the spacing between those legs 106 and that of the top legs 122 of the front adjustment brackets 116.

When the bar is in its lower, clamping position illustrated in full line in FIG. 14, it is releasably held there by spring biased detent pins 130 and 134 that fit into side detent grooves 131 of the bar. These detent pins 130 and 134 project from the top legs 106 and 122 of the rear and front adjustment brackets.

An upstanding handle 136 projects upwardly from the front end of the bar to aid in clamping and unclamping of the cable 30, and the bottom surface of the bar is faced with a resilient pressure pad 138 that forms the clamping surface.

To move the clamp 72 to the open position illustrated in phantom in FIG. 14, the handle 136 may be swung upwardly. The detent pins 130 and 134 cooperable with the side detent grooves 131 release upon application of the lifting force. The biased rear detent pins 130 are positioned relative to a rear ledge 137 of the bar 128 so as to provide for maintenance of the clamp at the angled position depicted in phantom in FIG. 14. When clamping is desired, the handle 136 is depressed causing the rear detent pins 130 to retract until eventually the front and rear pins 134 and 130 releasably lock in the groove 131.

As will be appreciated, when the flexible flat conductor means comprises flexible etched circuitry, the above-described guide and positioning assembly may either by dispensed with or appropriately modified to accommodate the flexible etched circuitry. Similarly, when shorter lengths of cable than that depicted are to be terminated, the above-described guide and positioning assembly may be dispensed with or means (not shown) may be provided to adjust the distance of that assembly from the anvil assembly.

The Anvil Assembly

Figure 15:
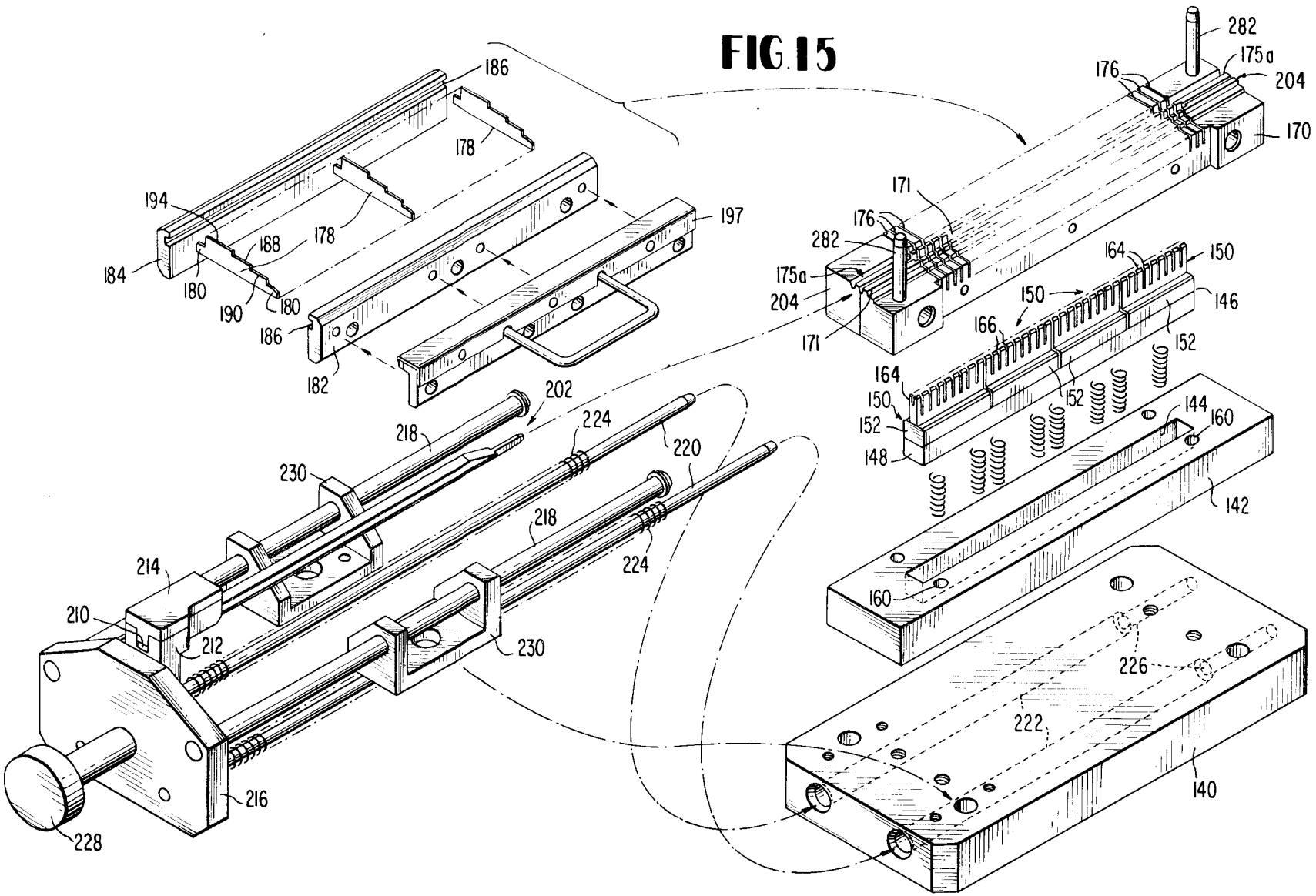
FIG. 15 is an exploded perspective view of the anvil assembly and stripper assembly of the apparatus.
Figure 16:
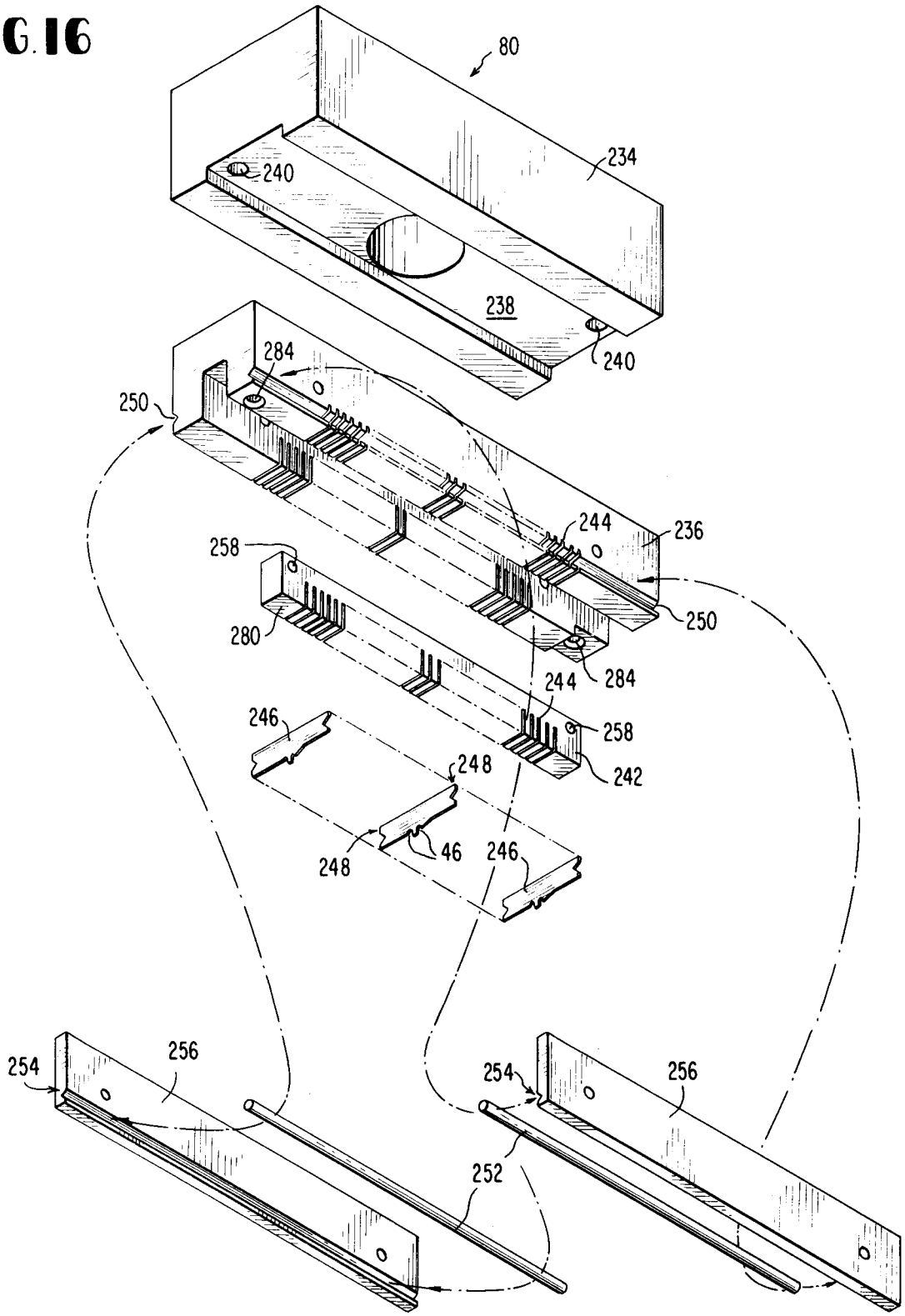
FIG. 16 is an exploded perspective view of the ram assembly.

One form of the previously mentioned anvil assembly 26 may be more fully appreciated with general reference to FIGS. 2, 3, 5, 7–10, and with particular reference to the exploded view of FIG. 15. The assembly includes a mounting plate 140 suitably fixed to the slide plate 24 of the machine.

Fixed on top of the mounting plate 140 is a spacer block 142. The spacer block has central, elongate cavity 144 for receiving an anvil pressure pad subassembly 146.

This pressure pad subassembly 146 includes an elongate pressure plate 148 that is receivable in the central cavity 144 of the spacer block 142. Fixedly mounted on the pressure plate 148 are a series of pressure pad units 150.

The pressure pad units 150 each have a lower block member 152 provided with receiving holes 154. (See FIG. 10.) These receiving holes 154 are aligned with receiving holes 156 in the pressure plate 148. Dowel pins 158 in the aligned holes 154 and 156 maintain the alignment of the pressure pad units 150 on the pressure plate 148. Screws 159 in central ones of the aligned holes 154 and 156 secure the pressure pad units 150 to the pressure plate.

The dowel pins 158 are aligned with spring receiving holes 100 that extend from the base of the central cavity 144 of the spacer block 142 through the block. Springs 162 in those spring receiving holes 160 bear between the upper surface of the pressure plate 148 at the location of the dowel pins 156 to normally bias the pressure pad subassembly 146 to an elevated position above the bottom of the mounting plate cavity 144, as shown in FIG. 10.

A series of generally U-shaped, upstanding projections 164, separated by slots 166, are machined in each pressure pad unit 150. These projections 164 are narrower than the blocks 152, and together they define a discontinuous ribbon support surface, indicated at 168 in FIG. 2, of the anvil assembly 26.

Fixedly mounted on the spacer block 142 is a die block 170. The die block includes a first central recess 172 (FIGS. 8 and 9) for receiving the lower block members 152 of the pressure pad units 150 and an upper portion of the pressure plate 148 when the pressure pad assembly is in its extended position. A narrower central recess 174 extends through the remainder of the die block 170. The series of projections 164 project through the latter recess 174 beyond the die block when the pressure pad assembly 146 is biased to its upper position.

On opposite sides of the narrow central recess 174, two ridges 171 are defined. (See FIG. 8.) One such ridge 171 is established by a cutaway section of the upper face of the die block 170 as indicated at 173. The other ridge 171 is established by a longitudinal groove 175 in that upper face. These ridges 171 continue beyond the zone of reception of the pressure pad projections to define U-shaped end sections as indicated at 175*a*.

Opening at the upper face of the die block 170 are a plurality of transversely extending slots 176. (See FIG. 15.) These slots 176 are longitudinally spaced at locations corresponding to the slots 166 between adjacent projections 164 of the pressure pad units 150 and the slots 176 extend entirely across the die block including through the ridges 171.

Received in each of the transverse die block slots 176 and between the projections 164 of the pressure pad units 150 is a die insert 178. As may be seen in FIG. 15, the ends of the die inserts are in the form of retainer ears 180. Insert retainer plates 182 and 184 extend along the sides of and are secured to the die block 170. These plates are grooved, as indicated at 186, for reception of the insert retainer ears 180 so as to maintain the inserts in assembled positions fixed to the die block 170.

Preferably the inserts 178 are made of hardened spring steel and have a thickness slightly greater than the thickness of the termination sections 38 of the contacts 36. Insert thicknesses on the order of 0.013 inch have been successfully employed in conjunction with termination sections of slightly smaller thickness.

Figure 9:
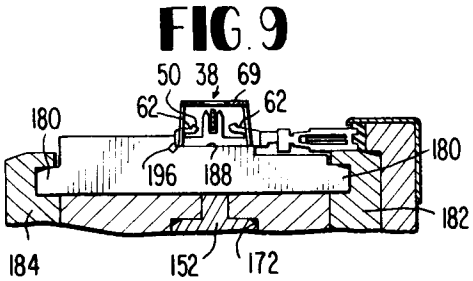
FIG. 9 is a cross-sectional view taken in the direction of line 9—9 of FIG. 7.

The upper portion of the die inserts 178 of FIG. 15 has a stepped profile. One surface 188 presented by this profile, i.e., the central one, acts as a support surface for a termination section 38 of a contact. An adjacent surface 190, stepped downwardly therefrom, accommodates clearance of the matable section 39 of the contact 36 where necessary. (See FIGS. 9 and 13.)

Where such clearances are not necessary, a shim 192 (see FIG. 12.) overlies the downwardly stepped surface 190 of the inserts and supports the matable section 39 of the contact, as in the case of a solder tab contact 36*a*. The shim plate 192 is removable when card edge contacts such as that shown in FIG. 13 are to be used for termination. If desired, a thinner shim plate (not shown) may be employed when the box contacts 36 of FIG. 9 are used for termination since not as much clearance is needed as with the card edge contacts 36*b* of FIG. 13. The shim plates, where employed when clearance is not needed, minimize the possibility of twisting of contacts during termination operations.

On the other side of the contact support surface 188 of each die insert 178 an upstanding ledge surface 194 may be provided. Such surface acts as a stop. When the contacts are positioned with their termination sections between the projections 164 on the pressure pad units 150 and resting on the insert support surface 188, and after removal of the carrier strip 37, the contacts 36 may be urged by the operator laterally until the termination sections abut the stop ledge 194. This provides alignment of the contact penetration prongs 44 with the legs of the projections 164. A different form of stop which is adjustable is described below in connection with FIGS. 17–21.

Upon actuation of the ram assembly 20, a portion of the ram die 40 to be described is lowered into engagement with the flexible flat conductor 30 overlying the discontinuous support surface 168 defined by the projections 164 of the pressure pad assembly 160. Further lowering of the ram depresses the spring biased pressure pad units 150 of which those projections 164 are a part. At the same time, the flexible flat conductor 30 clamped between the ram die 40 and the ribbon support surface 168 is forced to a lower position relative to the anvil die block 170, whereupon the conductors 32 of the flexible flat conductor 30 are initially penetrated by the penetration prongs 44 of the contact termination sections 38 and termination is completed as described above.

Figure 11:
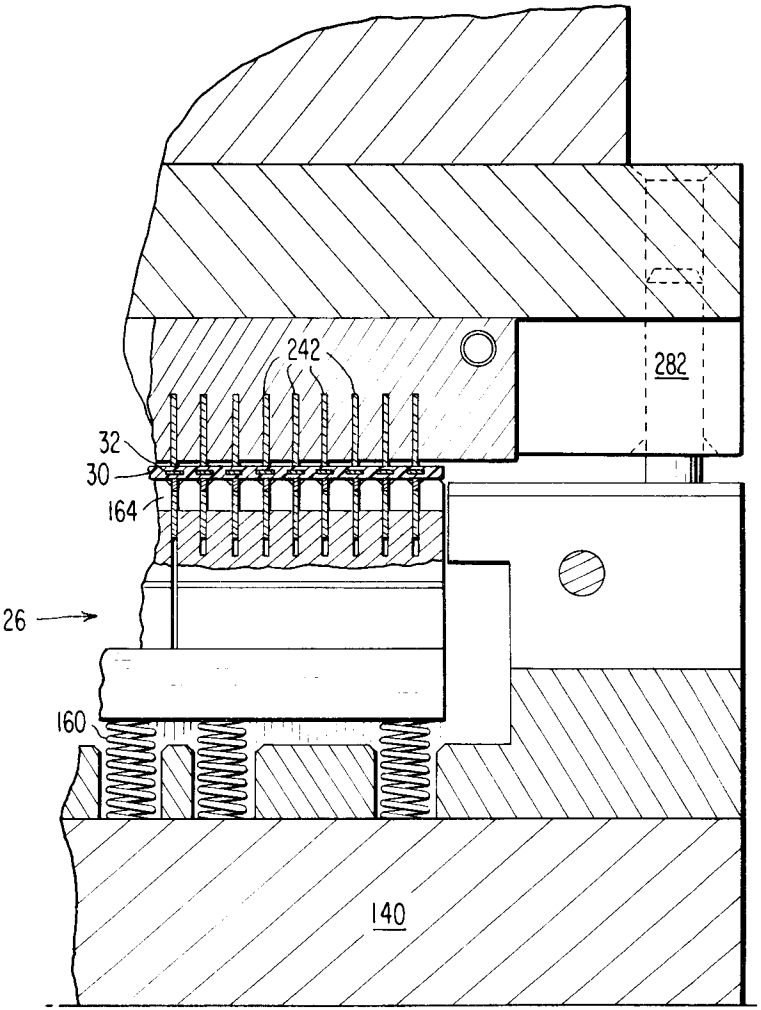
FIG. 11 is a partial cross-sectional view similar to FIG. 10, but showing portions of the ram assembly lowered for termination.

During lowering of the pressure pad assemblies 150 from the FIG. 10 position to the FIG. 11 position, the progressively lowered projections 164 thereof, of course, progressively expose the contact termination projections 44 to effect such penetration. However, as progressive portions of those penetrating projections 44 are exposed they are caused to be bent by the profile of the ram die searlier discussed.

Significant twisting, blending or buckling or unexposed portions of the projections 44 is impeded by the legs of the pressure pad projections 164 which are aligned with the contact penetration projections 44.

In this fashion, the plane of bending of the contact penetration projections 44 is controlled and lateral support for the contacts during bending is provided by insuring that substantially throughout the lancing operation, those penetration projections 44 are under the control of the pressure pad projections 164 and/or the arcuate ram die surfaces 46. The pressure pad projections 164 prevent significant excursion of unbent portions of the penetration projections 44 so as to impede twisting or bending thereof from the intended plane of forming during such forming, and so as to militate against failure of the projections by buckling.

After the ram is retracted, the springs 162 beneath the pressure pad assembly 146 bias that assembly towards the initial (FIG. 10) positions. As this occurs, the discontinuous ribbon support surface 168 of the anvil die assembly 42 exerts a lifting force on the cable 30. The lifting force is significantly advantageous in aiding in the removal of the now terminated cable.

As will be appreciated, the desirability of avoiding displacement of the penetration prongs 44 of the contact from the intended bending plane dictates rather close tolerances for the spacing between longitudinally spaced pressure pad projections 164. Therefore, the termination pockets defined by the projections 164 of the pressure pad units and the support surfaces 188 of the anvil inserts 176 are quite narrow. Termination forces may often cause expansion of portions of the termination section 38 of the contacts 36 so as to in effect lodge them in the rather confined space between those pressure pad projections, and in the lateral extensions of the termination pockets adjacent the ridges 171 on the anvil die block. Similarly, lodging may occur of contact portions in a notch 196 (see FIG. 9) of the insert provided to accommodate burrs on the contact termination sections.

The lifting force on the pressure pad subassembly 146 that is transmitted to the ribbon 30 by the springs 162 is designed to be sufficient to dislodge the contacts 36, thereby enabling the operator to easily remove the terminated cable 30.

Referring again particularly in FIGS. 4 and 15, a further feature of the anvil assembly 26 designed to militate against twisting of the matable sections 39 of the contacts 36 during termination may be seen. As shown therein, a pivotable retainer plate 197 is provided. This plate 197 is generally L-shaped in transverse section.

One leg of the plate 197 is mounted on loosely fitting bolts 198 secured to the one insert retaining plate 184 located adjacent the matable contact section 39. Springs 195 bear against the heads of the bolts 198 and that leg of the plate 197 to bias the retaining plate 197 to its contact retaining position.

In that position, the other, support leg of the plate brings a resilient pad 199 into contact with the matable contact sections 39. That leg faced by the resilient pad 199 thus holds those matable contact sections against pivoting. The retainer plate 197 may be moved outwardly against the bias of the springs 195 to allow for removal of the terminated cable or initial placement of the contacts.

The retainer plate 197 also may function as an indicator during initial contact placement. In this regard, if the contacts are not properly lying in the slots which receive them, those contacts interfere with movement of the retainer plate 197 to its retaining position toward which it is biased by the springs 198, thus providing a signal to the operator to orient the contacts by finger pressure prior to commencing termination.

Different clearances for the retaining ledge (i.e., the upper leg) of the retainer plate may be desired in conjunction with different configurations of the contact matable sections 39. Thus, several interchangeable retainer plates 197 may be provided for each anvil assembly.

With reference not to FIGS. 17–21, an alternative form of an anvil assembly 26 in accordance with the present invention may be seen.

In that form of the invention, the anvil die inserts 178 are modified to one side of the central contact support section 188. (See FIG. 21.) At that side, there is no raised section providing a stop ledge 194 and there is no retaining bar 180, unlike in the case of the inserts of FIG. 15. Instead, there is a lowered, cutaway section 260 that terminates in a vertical face 262. The upper surface of the anvil die block 170 is cut away in conformity with the modified insert 178.

The side face 264 of the die block 170 adjacent where the inserts and die block are modified as described is tapered. (See FIG. 18.) An upstanding face 266 of a locating fixture 268 is similarly tapered. The locating fixture 268 has a top ledge 270 that projects over the modified insert section 260. This ledge 260 acts as a retainer for the inserts 178 on the modified side. The leading face 272 of the ledge 270 acts as an adjustable stop for adjusting the position of the contacts on the support surfaces 188 of the inserts.

In this connection, an adjustment screw 274 is connected to one end of the locating fixture. That screw is controlled by a knurled adjusting knob 276. Turning of the knob 276 translates the tapered face 266 locating fixture 268 along the tapered face 264 of the anvil die block 170, thereby adjusting the lateral position of the stop face 272 of the top ledge of the locating fixture.

As will be noted, a bearing plate 278 bears against the locating fixture in several locations 280 on opposite sides of slots 282 in the side leg of the fixture. Screws hold the bearing plate 278 against the locating fixture 268 and anchor the bearing plate to the anvil die block 170. The slots 282 permit translation of the locating fixture 268 between the bearing plate 278 and the anvil die block.

The stop face 272 of the ledge 270 also acts to complete the definition of a locating groove 171, which in the case of the earlier described embodiment is completely formed by a groove in the upper face of the die block 170 itself.

Except as noted above, the anvil of FIGS. 17–21 is similar to that earlier described. However, the adjustment of the leading face 272 facilitates positioning of contacts of different dimensions with the prongs of the contacts properly located in alignment with the pressure pad projections.

When flat cable with round conductors is to be terminated, it is envisioned that the longitudinal extent of the anvil assemblies described above and the ram assembly to be described below may be at an angle with respect to a line perpendicular to the parallel round conductors of the cable, and the terms longitudinal extent and longitudinal spaced, etc. are intended to embrace such orientations.

The Stripper Assembly

Details of the previously identified stripper assembly 27 may be seen best in FIGS. 2, 3, 7–9 and 15.

The stripper assembly 27 includes a stripper bar 202 positioned in longitudinal alignment with the channel established between the legs of the projections 164 of the pressure pad units 150. When it is desired to remove the carrier strip 37 from the contacts 36 positioned on the anvil die 42, the stripper bar 202 is longitudinally advanced into that channel.

In this connection, the extended ridges 171 defining the U-shaped end section indicated at **175*a* on the upper face of the anvil die block 170 in front of and behind the zone where the pressure pad units are located (see FIG. 15) provide guide channels 204 that cooperate with the stripper bar 202. The stripper bar 202 itself is generally T-shaped in cross section throughout the greatest portion of its longitudinal extent (see FIG. 8), and the upstanding leg 206 of the T-shaped member is dimensioned to be received in the guide channels 204 of the anvil die block 170 and in the channel established between the legs of the projections 164 of the pressure pad units 150. That leg 206 is narrower than the channel 204 and has a height dimension equal to or greater than the distance by which the top of the pressure pad unit projections 164 extend above the base of guide channels 204 of the anvil die block 170, but less than the distance by which the base 69 of the carrier strip extends above the base of that guide channel 204** when the carrier is initially in position.

As such, the upstanding leg 206 of the stripper bar 202 cooperates with the guide channel 204 to properly orient the top leg 208 of that T-shaped bar for carrier strip removal.

The top leg 208 of the stripper bar is integral with the upstanding leg 206 and has a height dimension sufficient to project above the carrier strip base 69 when the carrier is in its initial position. The leading face of the stripper bar top leg 208 is tapered as indicated at 209 and terminates short of the leading end of the stripper bar upstanding leg 206.

To initiate a stripping operation, the stripper bar 202 is longitudinally advanced along the forward guide channel 204 of the anvil die block 270. In the normal, retracted position of the stripper bar 202, its upstanding leg 206 rests in the forward guide channel 204 short of the end thereof adjacent the location of the pressure pad units 150. (See FIG. 2.).

As the stripper bar 202 is advanced, the leading end of the upstanding leg 206 moves between the pressure pad projections 164 and beneath the base 69 of the carrier strip 37. Upon continued advance, the inclined forward face 209 of the stripper bar top leg 208 is operable through a wedging or camming action to peel or strip the carrier 37 from the contacts 36 positioned on the anvil. (See FIG. 7.) During a stripping operation, the upstanding leg 206 serves to hold down the contacts as the strip acted on by the tapered face 209 is peeled; and in this regard, the leading end of the upstanding leg is of particular import in holding down contacts forward of the flexed strip zone actually in contact with the tapered face 209. Ultimately, the entire carrier is thus removed from its contact locating position where one side leg is received in the locating groove 175 defined adjacent one ridge 171 and both side legs are in intimate contact with both ridges 171 of the upper face of the anvil die block.

As will be appreciated, the guide channel 204 defined by the ridges 171 of the anvil die block acts in cooperation with the upstanding leg 206 of the stripper bar 202 to laterally center the stripper bar 202 during its advance. At the same time, the elevation of the base of the guide channel 204 is such as to insure that the top leg 208 of the stripper bar can wedge the carrier 37 free while remaining above the extended pressure pad projections 164, and therefore above the contact termination projections 44 as to avoid damage thereto.

Mounting of the stripper bar 202 is accomplished by securing one end 210 thereof in a channel of a bracket member 212. This channel is closed by a fastening plate 214 that mates with the bracket member 212 and maintains the end 210 of the stripper bar clamped. The fastening plate 214 is secured to the bracket member 212 in any suitable manner, and the bracket member 212 is itself secured to a mounting plate 216 in any suitable manner.

Projecting from the mounting plate 216 and fixedly carried thereby are upper and lower pairs of guide rods 218 and 220. The lower guide rods 220 are slidably receivable in longitudinally extending guide holes 222 in the mounting plate 140 of the anvil assembly.

The forward portions of these guide holes 22 are enlarged to accommodate springs 224 which surround the lower guide rods 220. One end of these springs 224 bears against the mounting plate and the other end bears against a shoulder 226 defined at the juncture of the enlarged section of the guide hole 222 with that section of the guide hole that is dimensioned to accommodate just the guide rod.

Figure 2:
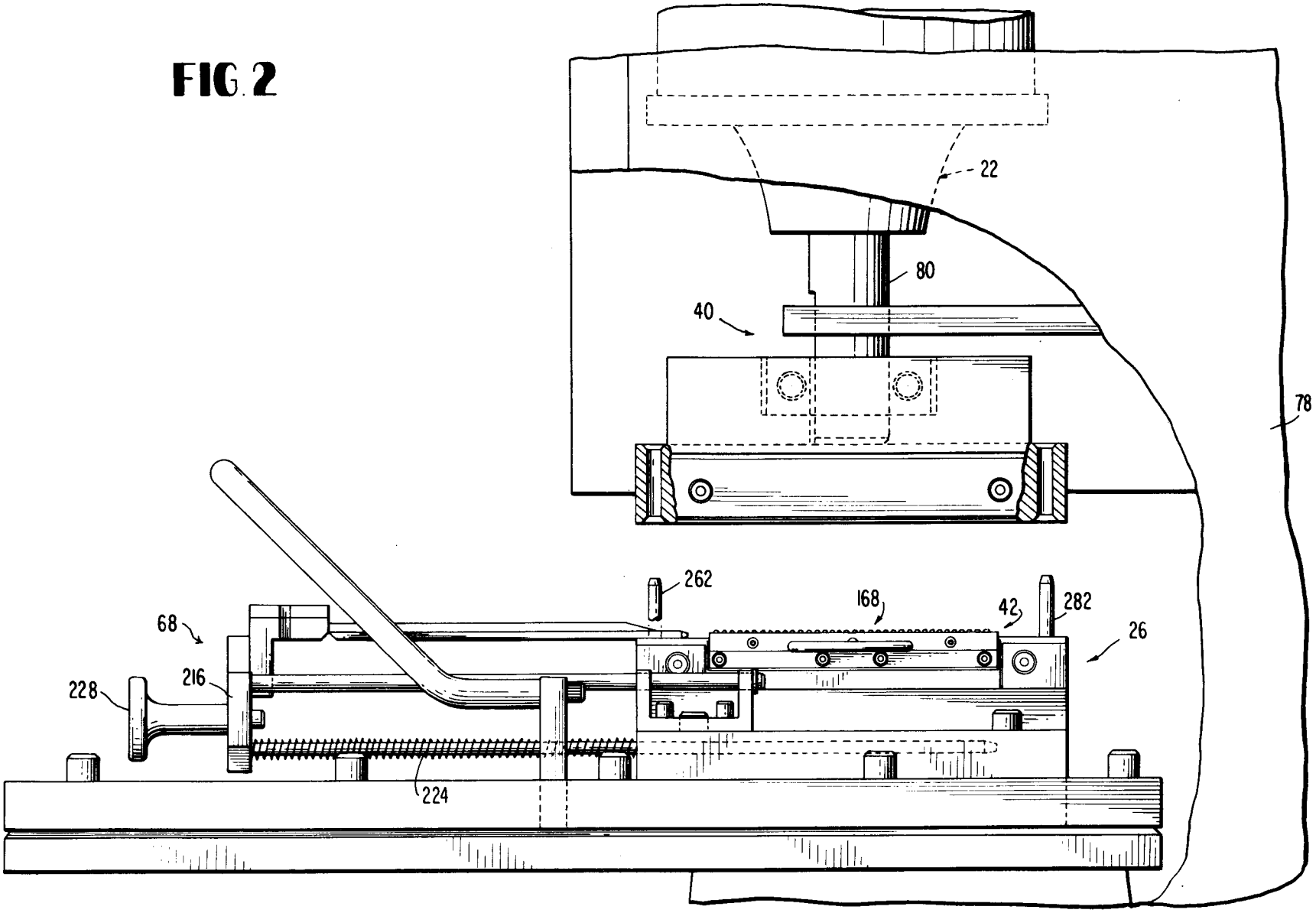
FIG. 2 is a side elevational view, partially broken away, of the apparatus schematically shown in FIG. 1, wherein the anvil assembly, stripper assembly and ram assembly may be seen, the guide and positioning assembly having been omitted for clarity.

As will be apparent, the springs 224 normally bias the entire stripper assembly 27 to the retracted position depicted in FIGS. 2 and 3. Advancement of the stripper assembly to cause progressive lifting of the carrier 37 from the contacts is accomplished against the bias of the springs 224, through the agency of a handle 228 projecting outwardly from the mounting plate 216.

The upper guide rods 218 are slidably received by aligned holes in legs of generally U-shaped brackets 230. These brackets 230 are mounted on the forward, side sections of the anvil assembly mounting plate 140 and secured thereto by suitable fasteners 232. Locating dowels 234 may be employed to aid in positioning of the brackets 230.

The Ram Assembly

With reference to FIGS. 1, 4, 5, 11 and 16, further structural and operational details of the ram assembly 22 may be appreciated. As earlier noted, the ram assembly includes an extensible and retractable ram arm 80 that may be operated in any suitable manner, such as hydraulically, pneumatically or otherwise. This ram arm is centrally fixed to a carrier block 234, which in turn carries the previously mentioned ram die assembly 40.

The ram die assembly is comprised of a ram die block 236, the upper face of which fits into a groove 238 in the lower face of the carrier block 234. The carrier block 234 and the ram die block 236 may be fixed to one another by screws (not shown) cooperable with holes 240 in the carrier block 234 and corresponding holes (not shown) in the ram die block 236.

The ram die block 236 is generally inverted U-shaped in transverse cross section. Positioned within the channel defined by the legs of the ram die block 236 is ram die insert receiving block 242. The ram die block 236 and the insert receiving block 242 are machined to provide longitudinally spaced insert receiving slots 244.

Spacing between these slots 244 corresponds to the longitudinal spacing of the insert receiving slots 176 in the anvil die block 170.

Ram die inserts 246 are located in the receiving slots 244 of the ram die block 236 and the receiving block 242. Each such insert 246 presents, in the central section thereof, the previously mentioned arcuate bending surfaces 46 and ram die nose 48. At the laterally outer sections, the ram die inserts are provided with retainer ears 248.

These retainer ears 248 are defined by laterally outwardly facing, generally V-shaped notches in the ends of the inserts 246. When the inserts 246 are fully received in the slots 244, the notches 248 are longitudinally aligned with generally V-shaped grooves 250 in the side legs of the ram die block 236.

Retention of the inserts 246 in assembled position is accomplished utilizing retaining rods 252 that fit into the grooves 250 in the side legs of the ram die block 236, into the grooves 248 of the inserts 246, and into inwardly facing grooves 254 in retainer plates 256.

These retainer plates 256 are fixed to the outer faces of the side legs of the ram die block 236 by fasteners 257. The fasteners 257 also project through holes 258 in the retainer block 242 and maintain that block in position.

Figure 5:
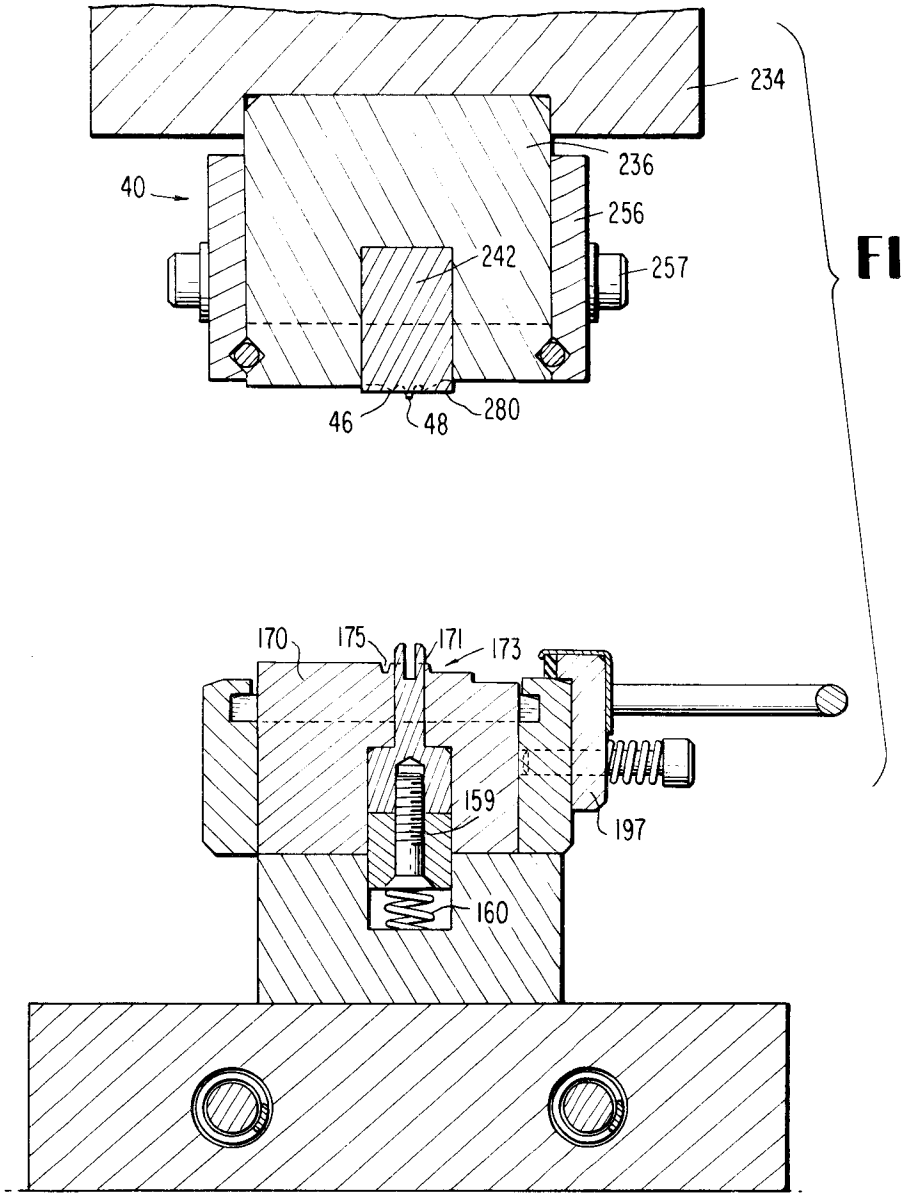
FIG. 5 is a cross-sectional view, similar to the right side section of FIG. 4 but taken through the anvil die block at a zone ahead of the location of an anvil die insert.
Figure 8:
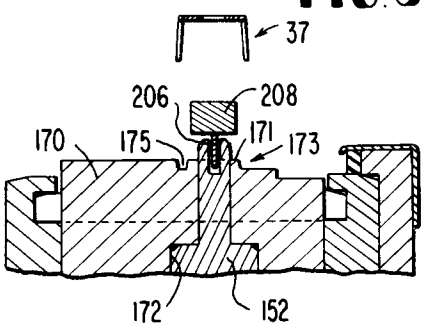
FIG. 8 is a cross-sectional view taken in the direction of line 8—8 of FIG. 7.

As may be seen in FIGS. 4 and 5, in its assembled position, the lower face 280 of the retainer block 242 projects below the lower face of the ram die block 236. Except for the lowermost portion of the ram die nose 48 which projects slightly below the lower face 280 of the retainer block 242, the die sections of the inserts 246 are bounded by the projecting walls of the retainer block on opposite side of the insert receiving slots 244.

Thus, ram assembly termination pockets are defined by the ram inserts 246 and these projecting walls whereby portions of the penetrating prongs under the control of the ram are impeded against moving out of the intended plane of forming by twisting or bending action.

When the ram die assembly 40 is extended toward the anvil die assembly 42, projecting dowels 282 on the anvil die assembly are received by holes 284 in the ram die block 236 to aid in maintaining the relative orientation of the assemblies 40 and 42 during contact termination.

Although the present invention has been described with reference to preferred forms thereof, it will be appreciated that substitutions, modifications, additions and deletions may be made without departing from the spirit and scope of the invention as defined in the appended claims.

what is claimed is:

1. Apparatus for terminating flexible flat conductor means with contacts having a termination section for terminating a conductor portion of the flexible flat conductor means, the apparatus comprising:

carrier means for removably carrying a plurality of longitudinally spaced ones of said contacts;

anvil means for receiving said carrier means and for simultaneously supporting said longitudinally spaced contacts prior to and during termination, said anvil means including:

a discontinuous support surface interrupted by open ends of a plurality of longitudinally spaced receiving slots for receiving said termination sections of said contacts carried by said carrier means prior to termination, anvil locating means cooperable with said carrier means for locating said longitudinally spaced contacts in position to effect termination; and holding means for holding said contacts against dislodgment from said anvil during removal of said carrier means from said contacts prior to termination;

positioning means for orienting said flexible conductor means adjacent said contact-carrying anvil means with said carrier means being removed from said contacts; and ram means movable relative to said anvil means with said flexible conductor means disposed between said ram means and said contact-carrying anvil means, for effecting simultaneous penetration of the flexible flat conductor means by said termination sections of contacts received in said receiving slots.

2. Apparatus according to claim 1 wherein said means for orienting said flat conductor means comprises guide and positioning means adjacent said anvil means for orienting the flexible conductor means relative to contacts positioned for termination thereof and including:

a support surface, first and second adjustable positioning stop means disposed on opposite sides of said conductor means and being mounted for relative movement toward and away from one another for adjusting to the particular width of the flexible flat conductor means being terminated, for predetermining the lateral location of said flexible flat conductor means and for preventing lateral movement of said conductor means relative to said anvil means, and movable clamp means for clamping said ribbon on said flexible flat conductor means on said support surface to prevent longitudinal movement of said conductor means relative to said anvil means.

3. Apparatus according to claim 2 wherein:

said first and second adjustable positioning stop means include latching means cooperable with said movable clamp means for releasably maintaining said clamp means in clamping position; and one of said adjustable positioning stop means includes mounting means for pivotally mounting said clamp means for movement between said clamping position and inactive positions.

4. Apparatus according to claim 3 wherein:

said latching means of said one of said adjustable positioning stop means also is operable to releasably maintain said clamp means in a stable inactive position.

5. Apparatus according to claim 1 wherein said anvil means comprises:

a plurality of longitudinally spaced, generally U-shaped projections presenting said discontinuous support surface and defining said spaced receiving slots therebetween;

said projections being arranged to lie adjacent said termination sections of said contacts to support said termination sections during penetration of said flat conductor means;

biasing means for yieldably urging said projections toward said ram means; and means for maintaining said contacts in position during termination while said ram means displaces said projections, relative to said contacts, against the urging of said biasing means.

6. Apparatus according to claim 5 wherein:

said carrier means comprises a flexible generally U-shaped carrier strip, and further including stripper means movable between said projections and between said carrier strip and said contacts for stripping said carrier strip from said contacts received in said slots;

said means for holding said contacts comprising a portion of said stripper means.

7. Apparatus according to claim 5 wherein said means for maintaining said contacts in position during termination comprises a plurality of anvil inserts removably inset in slots aligned with said receiving slots and provided in anvil block means, said anvil inserts comprising:

a contact supporting surface for supporting the termination section of the associated contact prior to and during termination and defining, together with said projections, narrow termination pockets.

8. Apparatus according to claim 7 including:

adjustable stop means providing a lateral adjustment for contacts located in said termination pockets.

9. Apparatus according to claim 7 wherein said ram means comprises a plurality of ram inserts removably inset in slots provided in ram means and aligned with said insert slots of said anvil means.

10. Apparatus according to claim 1 wherein said contacts have matable contact sections connected to said termination sections, and said anvil means includes:

retainer means for engaging and retaining the matable contact sections before and during termination.

11. Apparatus according to claim 1 wherein:

said carrier means comprises a flexible generally U-shaped carrier strip having spaced carrier tabs which carry said contacts, and including stripper means movable between said tabs for stripping said carrier strip from said contacts received in said slots prior to termination.

12. Apparatus for terminating flexible flat conductor means with contacts having a termination section including prongs for terminating a conductor portion of the flexible flat conductor means, the apparatus comprising:

anvil means for supporting the contacts in longitudinally spaced receiving slots during termination;

ram means movable relative to said anvil means for effecting penetration of the flexible flat conductor means by said prongs and bending said prongs to connect said contacts to said flexible flat conductor;

guide and positioning means adjacent said anvil means for orienting the flexible flat conductor means relative to contacts positioned for termination thereof;

said anvil means including projections disposed on opposite sides of said prongs;

biasing means for yieldably biasing said projections toward said ram means such that during penetration and bending of said prongs said projections are depressed while supporting said prongs against misdirected movement.

13. Apparatus according to claim 12 for use with a carrier strip carrying a plurality of longitudinally spaced ones of said contacts and wherein:

said anvil means includes anvil locating means cooperable with said carrier strip for locating said longitudinally spaced contacts in position to effect termination; the apparatus further comprising:

stripper means including a movable member mounted and aligned for movement between said carrier strip and said contacts for stripping said carrier strip from said positioned contacts.

14. Apparatus according to claim 13 wherein:

there are two of said projections situated on opposite sides of said contacts in alignment with two prongs of said contacts;

said projections form a discontinuous support surface interrupted by open ends of said plurality of longitudinally spaced receiving slots for receiving said termination sections of said contacts; and wherein said stripper means is movable between said projections.

15. Apparatus for terminating flexible flat conductor means with contacts having a termination section for terminating a conductor portion of the flexible flat conductor means, the apparatus comprising:

flexible, generally U-shaped carrier means having spaced legs for carrying a plurality of longitudinally spaced ones of said contacts;

anvil means for supporting said longitudinally spaced ones of said contacts during termination and including locating means cooperable with the legs of said generally U-shaped carrier means for positioning the contacts;

ram means movable relative to said anvil means for effecting penetration of the flexible flat conductor means by said termination section; and stripper means movable along a path between said contacts and said carrier means for stripping said carrier from said contacts.

16. Apparatus for use in terminating flexible flat conductor means with contacts having spaced, bendable, generally coplanar penetrating prongs for penetrating the flat conductor means and being crimped to the flat conductor means, the apparatus comprising:

elongate pressure pad means including a plurality of longitudinally spaced, generally U-shaped projections separated by slots and presenting a discontinuous support surface engageable with the flexible flat conductor means;

anvil die block means for mounting said pressure pad means;

spring means for yieldably biasing said pressure pad means to an extended position;

anvil die insert means also mounted by said anvil die block means and presenting a support surface for the contact termination sections between adjacent ones of said projections;

said pressure pad means, upon the application of termination force, being operable to responsively move relative to said anvil die insert means to a retracted position against the bias of said spring means; and said generally U-shaped projections of said elongate pressure pad means being operable to control the plane of bending of the contact penetrating prongs by establishing lateral support for those prongs during such bending.

17. Apparatus according to claim 16 including:

ram means for applying said termination force and including wall means defining pockets for additionally controlling the plane of bending of the contact penetrating prongs by establishing lateral support for leading portions of those prongs during such bending.

18. An anvil for use in terminating flexible flat conductor means with contacts having a termination section for terminating a conductor portion of the flexible flat conductor means, the anvil comprising:

elongate pressure pad means including a plurality of longitudinally spaced projections separated by slots and presenting a discontinuous support surface engageable with the flexible flat conductor means;

anvil die block means including a recessed zone for reception of said pressure pad means projections and including a plurality of receiving slots extending transversely of said recessed zone and aligned with said slots of said pressure pad means;

spring means for yieldably biasing said pressure pad means to an extended position;

anvil die insert means receivable in said receiving slots and said slots of said pressure pad means, and fixed in said anvil die block means;

said anvil die insert means presenting a support surface for the contact termination sections between adjacent ones of said projections;

said pressure pad means, upon the application of termination force, being operable to responsively move relative to said anvil die insert means to a retracted position against the bias of said spring means.

19. An anvil according to claim 18 wherein:

said projections of said pressure pad means define, together with said slots and said contact support surfaces of said insert means, narrow termination pockets, and said spring means is operable to urge said discontinuous support surface defined by said projections against a supported ribbon with a force sufficient to enforce dislodging of contacts from said termination pockets.

20. An anvil according to claim 19 wherein:

said projections in said extended position of said pressure pad means project above penetrating portions of the contacts on said support surfaces between adjacent ones of said projections; and said pressure pad means is operable during termination to responsively move to said retracted position to progressively expose those penetrating portions of the contacts.

21. An anvil according to claim 18 wherein:

said projections of said pressure pad means define, together with said slots and said contact support surfaces of said insert means, narrow termination pockets, said projections in said extended position of said pressure pad means project above penetrating portions of the contacts on said support surfaces between adjacent ones of said projections; and said pressure pad means is operable during termination to responsively move to said retracted position to progressively expose those penetrating portions of the contacts.

22. The anvil according to claim 18 for use in terminating said flexible flat conductor means with said contacts initially carried by a flexible, elongate generally U-shaped carrier strip supporting a plurality of said contacts in longitudinally spaced locations, wherein:

said anvil die block means includes elongate locating means, on opposite sides of said recess zone, cooperable with legs of said U-shaped carrier strip to orient said carrier strip with the contacts carried thereby received between adjacent ones of said projections.

23. Apparatus according to claim 22 wherein said projections of said pressure pad means are generally U-shaped and including:

stripping means movable generally centrally of said generally U-shaped projections for stripping the carrier from the contacts received between said projections.

24. Apparatus according to claim 23 wherein said stripping means comprises:

an elongate stripper bar generally T-shaped in cross section including a first leg receivable between said generally U-shaped projections, and a second leg disposed above said projections and cammingly engageable with the carrier strip for lifting the strip from the contacts.

25. Apparatus according to claim 18 wherein said projections of said pressure pad means define, together with said slots and said contact support surfaces of said anvil die insert means, narrow termination pockets, and including a ram comprising:

ram die block means defining a plurality of receiving slots extending transversely thereacross and longitudinally aligned with said receiving slots of said anvil die block means; and ram die insert means receivable in said ram die block receiving slots and including die surfaces aligned with said termination pockets.

26. Apparatus according to claim 25 wherein:

said ram die block means includes wall means defining, together with said ram die block insert means, narrow contact control pockets aligned with said termination pockets.

27. Apparatus according to claim 18 including:

adjustable stop means providing a lateral adjustment contacts received between said projections.

28. An anvil for use in terminating flexible flat conductor means with contacts having a termination section for terminating a conductor portion of the flexible flat conductor means, the anvil comprising:

a mounting plate;

a spacer block mounted on said mounting plate and having an elongate central cavity and a plurality of longitudinally spaced holes extending from the bottom of said cavity to said mounting plate;

an elongate pressure pad means receivable by said cavity and presenting a bearing surface to said spaced holes;

spring means in said spaced holes for yieldably biasing said pressure pad means to an extended position;

said pressure pad means including a plurality of longitudinally spaced projections separated by slots and presenting a discontinuous support surface engageable with the flexible flat conductor means;

anvil die block means including a recessed zone for reception of said pressure pad means projections;

said anvil die block means including a plurality of receiving slots extending transversely of said recessed zone and aligned with said slots of said pressure pad means;

anvil die inserts receivable in said receiving slots and said slots of said pressure pad means, and fixed in said die block means;

said anvil die inserts presenting a support surface for the contact termination sections between adjacent ones of said projections;

said pressure pad means, upon the application of termination force, being operable to responsively move relative to said anvil die inserts to a retracted position against the bias of said spring means.

29. The anvil according to claim 28 for use in terminating said flexible flat conductor means with said contacts initially carried by a flexible, elongate generally U-shaped carrier strip supporting a plurality of said contacts in longitudinally spaced locations, wherein:

said anvil die block means includes elongate locating means, on opposite sides of said recessed zone, cooperable with legs of said U-shaped carrier strip to orient said carrier strip with the contacts carried thereby received between adjacent ones of said projections.

30. The anvil assembly according to claim 29 wherein:

said locating means comprises elongate ridge means on opposite sides of said recessed zone and a groove defined alongside at least one of said ridge means for mating with one leg of said carrier strip.

31. The anvil according to claim 30 wherein:

said ridge means defines an elongate generally U-shaped die section longitudinally aligned with said projections of said pressure pad means;

said ridge means are elevated above said contact support surface of said inserts and said transverse receiving slots extend across said ridge means; and said spring means is operable to urge said discontinuous support surface defined by said pressure pad projections against a supported ribbon with a force sufficient to enforce dislodging of contact portions lodged during termination.

32. The anvil according to claim 31 wherein:

the projections of said pressure pad means in said extended position thereof are operable to project above penetrating portions of the contacts on said support surfaces between adjacent ones of said projections, and said pressure pad means is operable during termination to responsively move to said retracted position relative to said anvil die inserts to progressively expose those penetrating portions of the contacts.

33. Apparatus according to claim 32 wherein:

said projections of said pressure pad means are generally U-shaped;

stripping means movable generally centrally of said ridge means and said projections for stripping the carrier from the contacts received between said projections.

34. Apparatus according to claim 33 wherein said stripping means comprises:

an elongate stripper bar generally T-shaped in cross section including a first leg receivable between said projections, and a second leg disposed above said projections and cammingly engageable with the carrier strip for lifting the strip from the contacts.

35. Apparatus according to claim 34 including:

stripper spring means for biasing said stripper bar to a retracted position remote from said projections; and guide means for guiding the advance and retraction of said stripper bar.

36. Apparatus according to claim 35 wherein:

said anvil die block means includes ridge guide means, generally aligned with said ridge means disposed on opposite sides of said recess means, and operable to guide said first leg of said stripper bar when advanced toward said projections.

37. The anvil of claim 28 wherein:

the projections of said pressure pad means in said extended position thereof are operable to project above penetrating portions of the contacts on said support surfaces between adjacent ones of said projections, and said pressure pad means is operable during termination to responsively move to said retracted position relative to said anvil die inserts to progressively expose those penetrating portions of the contacts.

38. Apparatus according to claim 29 including:

stripping means movable generally centrally of said projections for stripping the carrier from the contacts received therebetween.

39. Apparatus according to claim 30 wherein:

said projections of said pressure pad means are generally U-shaped;

said ridge means define an elongate generally U-shaped die section longitudinally aligned with said projections of said pressure pad means;

said ridge means are elevated above said contact support surface of said inserts and said transverse receiving slots extend across said ridge means.

40. Apparatus according to claim 39 wherein said stripping means comprises:

an elongate stripper bar generally T-shaped in cross section including a first leg receivable between said projections, and a second leg disposed above said projections and cammingly engageable with the carrier strip for lifting the strip from the contacts.

41. Apparatus according to claim 40 wherein:

said anvil die block means includes ridge guide means, generally aligned with said ridge means disposed on opposite sides of said recess means, and operable to guide said first leg of said stripper bar when advanced toward said projections.

42. The anvil according to claim 28 wherein:

said spring means is operable to urge said discontinuous support surface defined by said pressure pad projections against a supported ribbon with a force sufficient to enforce dislodging of contact portions lodged during termination.

43. Apparatus according to claim 28 including a ram comprising:

ram die block means including a plurality of receiving slots extending transversely thereacross and longitudinally aligned with said receiving slots of said anvil die block means; and ram die inserts receivable in said ram die block receiving slots and including die surfaces projectable into said slots separating said projections.

44. Apparatus according to claim 28 including:

adjustable stop means providing a lateral adjustment for contacts received between said projections.

* * * * *